US010539139B2

(12) United States Patent
Noro et al.

(10) Patent No.: US 10,539,139 B2
(45) Date of Patent: Jan. 21, 2020

(54) COMPRESSOR

(71) Applicant: DAIKIN INDUSTRIES, LTD., Osaka-shi, Osaka (JP)

(72) Inventors: Masahiro Noro, Sakai (JP); Yasuhiro Murakami, Sakai (JP); Kouji Tanaka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/506,207

(22) PCT Filed: Aug. 28, 2015

(86) PCT No.: PCT/JP2015/074384

§ 371 (c)(1),
(2) Date: Feb. 23, 2017

(87) PCT Pub. No.: WO2016/035697

PCT Pub. Date: Mar. 10, 2016

(65) Prior Publication Data

US 2017/0254331 A1 Sep. 7, 2017

(30) Foreign Application Priority Data

Sep. 1, 2014 (JP) ..... 2014-177479

(51) Int. Cl.
*F04C 29/00* (2006.01)
*F04C 29/02* (2006.01)
*F04C 18/02* (2006.01)

(52) U.S. Cl.
CPC ..... *F04C 29/0057* (2013.01); *F04C 18/0215* (2013.01); *F04C 29/0085* (2013.01); *F04C 29/02* (2013.01); *F04C 2240/40* (2013.01)

(58) Field of Classification Search
CPC ..... F04C 18/0215; F04C 2240/807; F04C 2/025; F04C 15/0088–0092;
(Continued)

(56) References Cited

U.S. PATENT DOCUMENTS 5,380,170 A * 1/1995 Fain ..... F04B 39/0261 184/6.18
6,135,738 A * 10/2000 Kajiwara ..... F04C 18/0215 418/55.4
(Continued)

FOREIGN PATENT DOCUMENTS

JP 2003-293955 A 10/2003
JP 2010-138863 A 6/2010
(Continued)

OTHER PUBLICATIONS

JP 2012202208A Machine Translation.*
(Continued)

*Primary Examiner* — Alexander B Comley
(74) *Attorney, Agent, or Firm* — Global IP Counselors, LLP

(57) ABSTRACT

A compressor includes a crankshaft, an electric motor, a counterweight, and an oil outflow reduction member. The electric motor has a rotor coupled to the crankshaft and a stator in which the rotor is housed with an air gap formed between the stator and the rotor. The counterweight is disposed adjacent to the rotor and is integrated with the crankshaft. The oil outflow reduction member encloses an upper side, a lower side, and a lateral side of a counterweight passing space. The counterweight passing space is a space through which at least part of the counterweight passes when the crankshaft rotates 360°.

21 Claims, 12 Drawing Sheets

(58) Field of Classification Search
CPC .... F04C 18/0207–0238; F04C 29/0057; F04C 29/02–028; F04B 39/02–39/0253; F04B 53/18
USPC ..... 417/410.1, 410.3–410.5; 418/43, 418/55.1–55.6, 151
See application file for complete search history.

(56) References Cited

U.S. PATENT DOCUMENTS

| | | | | |
|---|---|---|---|---|
| 7,384,250 | B2 * | 6/2008 | Shin | F04C 18/0215 184/6.18 |
| 7,771,180 | B2 * | 8/2010 | Cho | F04C 18/0215 418/55.6 |
| 2006/0127262 | A1 | 6/2006 | Shin et al. | |
| 2008/0175738 | A1 | 7/2008 | Jung et al. | |
| 2010/0150752 | A1 | 6/2010 | Nakamura et al. | |
| 2015/0184652 | A1 | 7/2015 | Murakami | |

FOREIGN PATENT DOCUMENTS

| | | | | |
|---|---|---|---|---|
| JP | 2010-209855 | A | | 9/2010 |
| JP | 4874628 | B2 | | 12/2011 |
| JP | 2012-202208 | A | | 10/2012 |
| JP | 2012202208 | A | * | 10/2012 |
| WO | 2008/088112 | A1 | | 7/2008 |
| WO | 2014/021302 | A1 | | 2/2014 |

OTHER PUBLICATIONS

Notification of Reasons for Refusal of corresponding JP Application No. 2014-177479 dated Nov. 24, 2015.
Notification of Reasons for Refusal of corresponding JP Application No. 2014-177479 dated Jul. 12, 2016.
European Search Report of corresponding EP Application No. 15 83 8882.7 dated May 4, 2017.
International Search Report of corresponding PCT Application No. PCT/JP2015/074384 dated Dec. 1, 2015.
International Preliminary Report of corresponding PCT Application No. PCT/JP2015/074384 dated Aug. 28, 2015.

* cited by examiner

COMPRESSOR

CROSS-REFERENCE TO RELATED APPLICATIONS

This U.S. National stage application claims priority under 35 U.S.C. § 119(a) to Japanese Patent Application No. 2014-177479, filed in Japan on Sep. 1, 2014, the entire contents of which are hereby incorporated herein by reference.

TECHNICAL FIELD

The present invention relates to a compressor.

BACKGROUND ART

Conventionally, compressors have been known where, in order to reduce the outflow of refrigerating machine oil to the outside of the compressor (oil outflow), a cover shaped like an open half cylinder is attached to a counterweight to thereby reduce scattering of the refrigerating machine oil when the counterweight rotates (e.g., FIG. 1 of JP-A No. 2010-138863).

SUMMARY

Technical Problem

However, the compressor of FIG. 1 in JP-A No. 2010-138863 has the following kinds of problems.

FIG. 13 is a general plan view in which a counterweight B arranged above the rotor of the electric motor of the compressor of FIG. 1 in JP A No. 2010-138863 is viewed from above. Let it be supposed that a crankshaft rotates and the counterweight B attached to the crankshaft rotates counter-clockwise as indicated by the arrow in the drawing. In this case, in the space enclosed by the cover attached to the counterweight 13, the pressure on the forward side in the rotational direction of the counterweight B (the region indicated by P in FIG. 13) increases (resulting in positive pressure) while the pressure on the rear side in the rotational direction of the counterweight B (the region indicated by N in FIG. 13) decreases (resulting in negative pressure).

Additionally, because of the negative pressure on the rear side in the rotational direction of the counterweight B, a gas flow speed in passageways (e.g., an air gap between the rotor and the stator of the electric motor, holes running vertically through the rotor such as those disclosed in JP A No 2010-209855, etc. communicating the space below to the space above the rotor of the electric motor partially increases and refrigerating machine oil in the space below the rotor is thereby easily carried to the space above the rotor. That is to say, the compressor of FIG. 1 of JP-A No. 2010-138863 also has a problem that the oil outflow can be caused relatively easily.

To address this, if the lower side of the cover is closed off as in the compressor of FIG. 2 in JP-A No. 2010-138863, the space of the negative pressure arising on the rear side in the rotational direction of the counterweight B becomes no longer directly communicated to the passageways communicating the space below to the space above the rotor of the electric motor. For that reason, in the compressor of FIG. 2 in JP-A No. 2010-138863, the oil outflow caused by the effect of the negative pressure which arises as a result of the rotation of the counterweight B may be reduced. However, if the lower side of the cover is closed off as described in JP-A No. 2010-138863, the refrigerating machine oil may be collected in the space enclosed by the cover, and thereby the oil outflow may be actually promoted and the efficiency of the compressor may be deteriorated.

The object of the present invention is providing a compressor which uses a counterweight and can reduce oil outflow caused by the counterweights.

Solution to Problem

A compressor pertaining to a first aspect of the present invention is equipped with a crankshaft, an electric motor, a counterweight, and an oil outflow reduction member. The electric motor has a rotor coupled to the crankshaft and a stator in which the rotor is housed via an air gap. The counterweight is disposed adjacent to the rotor and is integrated with the crankshaft. The oil outflow reduction member encloses an upper side, lower side, and lateral side of a counterweight passing space that is a space through which at least part of the counterweight passes when the crankshaft rotates 360°.

Here, as the counterweight passing space is enclosed by the oil outflow reduction member, a movement of refrigerating machine oil is hardly caused by a pressure difference around the counterweight, which arises from the rotation of the counterweight, in passageways communicating between the space on one end side of the rotor and the space on the other end side of the rotor. Furthermore, here, as the counterweight passing space is enclosed by the oil outflow reduction member, it is difficult for the refrigerating machine oil to be collected in the counterweight passing space. For these reasons, it is easy for the oil outflow caused by the counterweight to be reduced.

A compressor pertaining to a second aspect of the present invention is the compressor pertaining to the first aspect, wherein the oil outflow reduction member rotates integrally with the crankshaft.

Here, as the oil outflow reduction member is a structure that rotates integrally with the crankshaft, it is easy to enclose the counterweight passing space with the oil outflow reduction member, and it is difficult for a pressure difference to occur around the counterweight. For this reason, it is easy for the oil outflow caused by the counterweight to be reduced.

A compressor pertaining to a third aspect of the present invention is the compressor pertaining to the first aspect or the second aspect, wherein the oil outflow reduction member is formed in the shape of a cylinder extending in the axial direction of the crankshaft.

Here, as the oil outflow reduction member is formed in the shape of the cylinder extending in the axial direction, it is difficult for a pressure difference to arise around the oil outflow reduction member. For this reason, it is easy for the oil outflow to be reduced.

A compressor pertaining to a fourth aspect of the present invention is the compressor pertaining to the third aspect, wherein the oil outflow reduction member includes a disc which encloses the rotor side of the counterweight passing space. The counterweight and the disc are formed integrally with the crankshaft.

Here, as the disc on the rotor side of the oil outflow reduction member and the counterweight are formed integrally with the crankshaft, the number of parts can be reduced.

A compressor pertaining to a fifth aspect of the present invention is the compressor pertaining to the third aspect, wherein the oil outflow reduction member includes the disc that encloses the rotor side of the counterweight passing space. The disc is formed in an annular shape and is formed as a member separate from the crankshaft.

Here, as the disc on the rotor side of the oil outflow reduction member is formed as a member separate from the crankshaft, the shape of the crankshaft can be made simpler and the process of manufacturing the crankshaft can be made easier.

A compressor pertaining to a sixth aspect of the present invention is the compressor pertaining to the fifth aspect, wherein the counterweight includes a first counterweight and a second counterweight. The first counterweight is formed integrally with the disc and is disposed on the rotor side. The second counterweight is formed integrally with the crankshaft and is coupled to the first counterweight by a fastening member. The fastening member is disposed in such a way that it does not project on the rotor side from the disc.

Here, as the fastening member which couples the first counterweight and the second counterweight does not project on the rotor side from the disc, it is easy to prevent that the refrigerating machine oil mist becomes finer as a result of refrigerant gas being agitated by the fastening member and the refrigerating machine oil thereby easily flows out together with the refrigerant gas to the outside of the compressor.

A compressor pertaining to a seventh aspect of the present invention is the compressor pertaining to any of the fourth aspect to the sixth aspect, wherein the oil outflow reduction member includes a cover. The cover encloses the lateral side of the counterweight passing space and a side of the counterweight passing space distal from the rotor in the axial direction of the crankshaft.

Here, as the cover is manufactured as a separate member, it is easy for the production of the oil outflow reduction member to be made easier compared to a case where the oil outflow reduction member is integrally formed.

A compressor pertaining to an eighth aspect of the present invention is the compressor pertaining to the seventh aspect, wherein the counterweight is disposed above the rotor. A gap is formed between the disc and the cover in at least part of the area between them.

Here, as the gap is formed between the disc and the cover, even if the refrigerating machine oil enters the counterweight passing space (the space inside the oil outflow reduction member) from a gap between the cover and the crankshaft, the refrigerating machine oil can be expel led. Therefore, imbalances in rotating bodies which arise as a result of the refrigerating machine oil being collected in the counterweight passing space can be prevented and a drop in the efficiency of the compressor can be prevented.

A compressor pertaining to a ninth aspect of the present invention is the compressor pertaining to the eighth aspect, wherein the outer diameter of the disc is larger than the outer diameter of the rotor formed in the shape of a cylinder and is smaller than the inner diameter of the stator in which the rotor is housed.

Here, as the outer diameter of the disc is larger than the outer diameter of the rotor, when the refrigerating machine oil in the counterweight passing space is expelled from the gap between the disc and the cover, it is easy for the expelled refrigerating machine oil to be kept from being scattered by the flow of refrigerant gas and being carried together with the refrigerant gas to the outside of the compressor. Furthermore, as the outer diameter of the disc is smaller than the inner diameter of the stator, the crankshaft having the oil outflow reduction member attached there to can be inserted inside the stator and the assembling work of the compressor is not hindered because of the presence of the disc.

A compressor pertaining to a tenth aspect of the present invention is the compressor pertaining to any of the fourth aspect to the eighth aspect, wherein the radius of the disc is identical to the radius of the counterweight formed in a semicircular shape.

Here, as the radius of the disc of the oil outflow reduction member and the radius of the counterweight are formed identical to each other, it is difficult for a pressure difference around the rotating bodies to occur.

A compressor pertaining to an eleventh aspect of the present invention is the compressor pertaining to any of the fourth aspect to the eighth aspect, wherein the outer diameter of the disc is equal to or smaller than the outer diameter of the rotor formed in the shape of a cylinder.

Here, as the outer diameter of the disc of the oil outflow reduction member is formed equal to or smaller than the outer diameter of the rotor, it is easy to insert the crankshaft having the oil outflow reduction member attached thereto into the inside of the stator, and the assembly of the compressor can be made easier.

Advantageous Effects of Invention

In the compressor pertaining to the present invention, as the counterweight passing space is enclosed by the oil outflow reduction member, a movement of the refrigerating machine oil is hardly caused by a pressure difference around the counterweight, which arises from the rotation of the counterweight, in the passageways communicating between the space on one end side of the rotor and the space on the other end side of the rotor. Furthermore, here, as the counterweight passing space is enclosed by the oil outflow reduction member, it is difficult for the refrigerating machine oil to be collected in the counterweight passing space. For these reason, it is easy for the oil outflow caused by the counterweight to be reduced.

BRIEF DESCRIPTION OF DRAWINGS

FIG. 2 depicts a state in which a cover of an oil outflow reduction member is cut by a plane extending in the axial direction of a crankshaft.

FIG. 5 depicts a state in which a cover of an oil outflow reduction member is cut by a plane extending in the axial direction of a crankshaft.

FIG. 11 depicts a state in which a cover of an oil outflow reduction member is cut by a plane extending in the axial direction of a crankshaft.

DESCRIPTION OF EMBODIMENTS

Embodiments of a compressor pertaining to the present invention will be described with reference to the drawings. It should be noted that the following embodiments are merely examples and can be appropriately changed to the extent that they do not depart from the scope of the present invention.

First Embodiment

A scroll compressor 10 pertaining to a first embodiment of the present invention will be described.

(1) Overall Configuration

Figure 1:
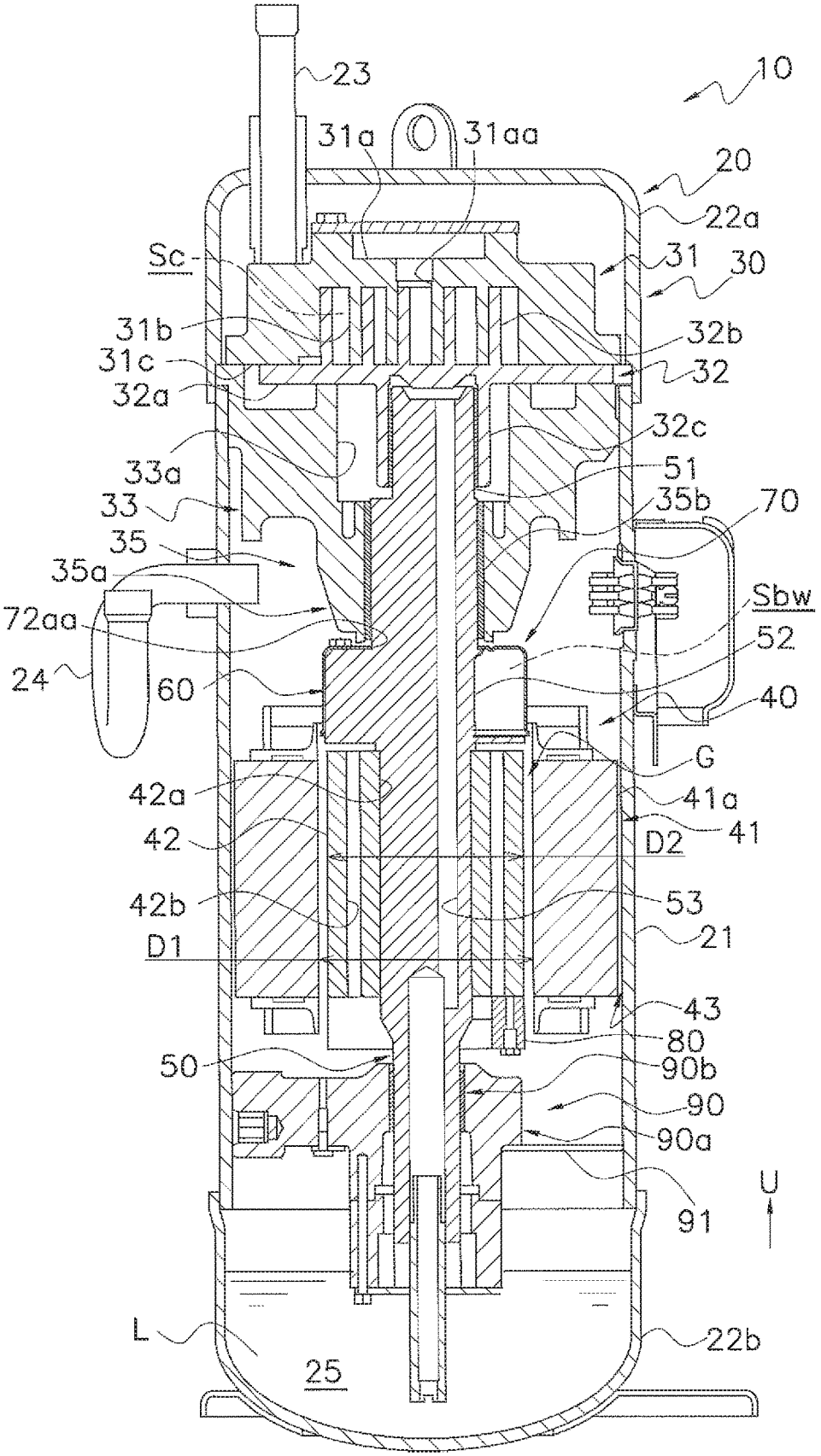
FIG. 1 is a general longitudinal sectional view of a scroll compressor pertaining to a first embodiment of the present invention.
Figure 2:
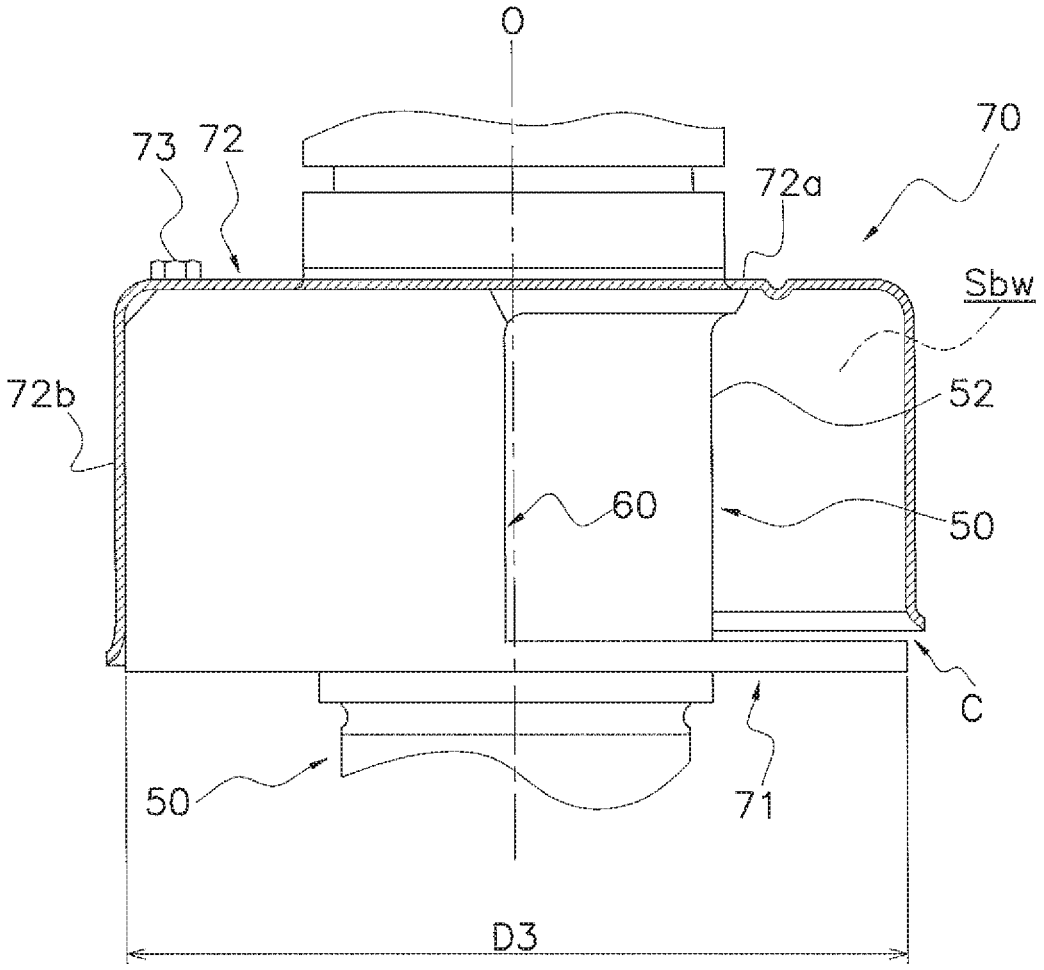
FIG. 2 is an enlarged view of the area around an upper counterweight of the scroll compressor of FIG. 1.
Figure 3:
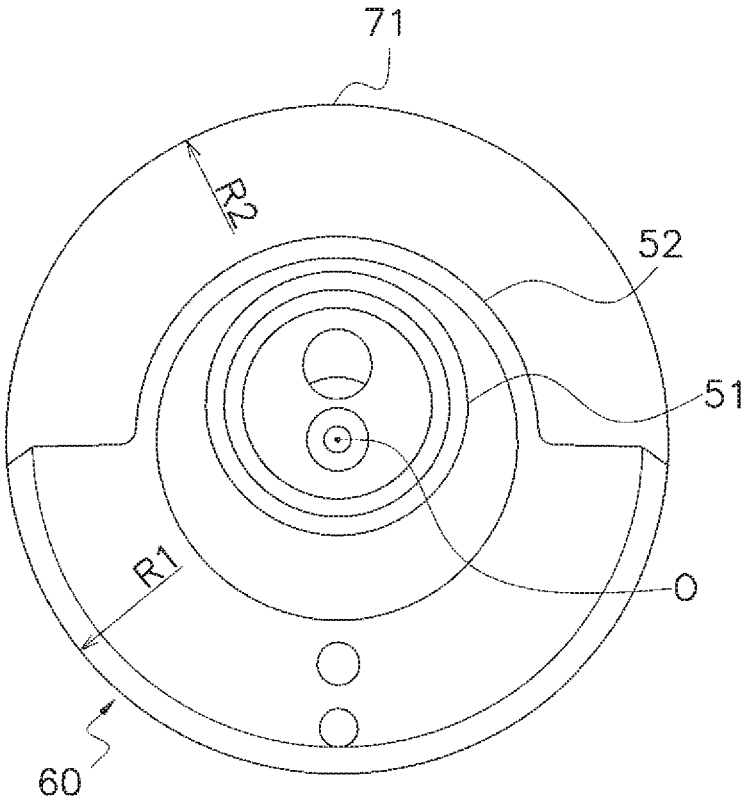
FIG. 3 is a plan view in which the crankshaft and the upper counterweight of the scroll compressor of FIG. 1 are viewed from above in a state in which the cover of the oil outflow reduction member is detached.

FIG. 1 is a general longitudinal sectional view of the scroll compressor 10 pertaining to the first embodiment. FIG. 2 is an enlarged view of the area around a later-described upper counterweight 60 of the scroll compressor 10. FIG. 2 depicts a state in which a cover 72 of a later-described oil outflow reduction member 70 is cut by a plane extending in the axial direction of a later-described crankshaft 50. FIG. 3 is a plan view in which the crankshaft 50 and the upper counterweight 60 of the scroll compressor 10 are viewed from above in a state in which the cover 72 of the oil outflow reduction member 70 is detached.

The scroll compressor 10 is, for example, used in an outdoor unit of an air conditioning apparatus and constitutes a part of a refrigerant circuit of the air conditioning apparatus.

The scroll compressor 10 mainly has a casing 20, a compression mechanism 30, an electric motor 40, the crankshaft 50, the upper counterweight 60, the oil outflow reduction member 70, a lower counterweight 80, and a lower bearing 90 (see FIG. 1).

(2) Detailed Configuration

The configuration of the scroll compressor 10 will be described in detail below. It should be noted that in the following description expressions such as "upper" and "lower" are sometimes used in order to describe directions and positions, and unless otherwise specified the direction of arrow U in FIG. 1 indicates upward.

(2-1) Casing

The scroll compressor 10 has the casing 20, which is shaped like a vertically long cylinder (see FIG. 1). The casing 20 has a tubular member 21, which is shaped like a cylinder whose top and bottom are open, and an upper lid 22*a* and a lower lid 22*b*, which are disposed on the upper end and the lower end, respectively, of the tubular member 21 (see FIG. 1). The upper lid 22*a* and the lower lid 22*b* are secured by welding to the tubular member 21 so as to be airtight.

In the casing 20, components of the scroll compressor 10 including the compression mechanism 30, the electric motor 40, the crankshaft 50, the upper counterweight 60, the oil outflow reduction member 70, the lower counterweight 80, and the lower bearing 90 (see FIG. 1) are housed. Furthermore, an oil collection space 25 is formed in the lower portion of the casing 20 (see FIG. 1). Refrigerating machine oil L for lubricating the compression mechanism 30 and other components is collected in the oil collection space 25.

In the upper portion of the casing 20, a suction pipe 23 that sucks in gas refrigerant, which is the compression object of the compression mechanism 30, is disposed through the upper lid 22*a* (see FIG. 1). The lower end of the suction pipe 23 is connected to a fixed scroll 31 of the later-described compression mechanism 30. The suction pipe 23 is communicated to a later-described compression chamber Sc of the compression mechanism 30. Low-pressure gas refrigerant before compression is supplied to the suction pipe 23 from the refrigerant circuit to which the scroll compressor 10 is connected.

A discharge pipe 24, through which the gas refrigerant that is discharged out of the casing 20 passes, is disposed in a middle portion of the tubular member 21 of the casing 20 (see FIG. 1). The discharge pipe 24 is installed in such a way that the end portion of the discharge pipe 24 inside the casing 20 projects below a housing 33 of the compression mechanism 30. High-pressure gas refrigerant that has been compressed by the compression mechanism 30 passes through the discharge pipe 24 and is discharged to the out of the casing 20.

(2-2) Compression Mechanism

The compression mechanism 30 is disposed in the upper portion of inside of the casing 20 (see FIG. 1). The compression mechanism 30 mainly has the housing 33, the fixed scroll 31, and a movable scroll 32 (see FIG. 1). The fixed scroll 31 is disposed above the housing 33. The compression chamber Sc that compresses the refrigerant is formed between the fixed scroll 31 and the movable scroll 32.

(2-2-1) Fixed Scroll

The fixed scroll 31 mainly has a fixed-side end plate 31*a* that is shaped like a disc, a fixed-side wrap 31*b* that is shaped like a spiral and projects downward from the lower surface of the fixed-side end plate 31*a*, and a peripheral portion 31*c* that encloses the fixed-side wrap 31*b* (see FIG. 1).

In the central portion of the fixed-side end plate 31*a*, a noncircular discharge port 31*aa* communicated with the later-described compression chamber Sc is formed through the fixed-side end plate 31*a* in its thickness direction (see FIG. 1). The gas refrigerant that has been compressed in the compression chamber Sc is discharged upward from the discharge port 31*aa*, passes through non-illustrated refrigerant passageways formed in the fixed scroll 31 and in the housing 33, and then flows into the space below the housing 33.

The peripheral portion 31*c* is formed on the outer peripheral edge of the lower portion of the fixed scroll 31. The peripheral portion 31*c* is formed in an annular shape and is disposed enclosing the fixed-side wrap 31*b*. The fixed scroll 31 is secured to the housing 33, at the peripheral portion 31*c*.

(2-2-2) Movable Scroll

The movable scroll 32 has a movable-side end plate 32*a* that is shaped like a disc, a movable-side wrap 32*b* that is shaped like a spiral and projects from the upper surface of the movable-side end plate 32*a*, and a boss portion 32*c* that is formed in the shape of a cylinder and projects from the lower surface of the movable-side end plate 32*a* (see FIG. 1).

The fixed-side wrap 31*b* and the movable-side wrap 32*b* are put together in such a way that the lower surface of the fixed-side end plate 31*a* and the upper side of the movable-side end plate 32*a* oppose each other, and the compression chamber Sc is formed between the fixed-side wrap 31*b* and the movable-side wrap 32*b*, which are adjacent to each other.

The boss portion 32*c* is a part shaped like an open cylinder whose upper end is closed off by the movable-side end plate 32*a*. The movable scroll 32 and the crankshaft 50 are coupled to each other as a result of a later-described eccentric portion 51 of the crankshaft 50 being inserted into the boss portion 32*c*.

The movable scroll 32 is supported by the later-described housing 33 via a non-illustrated Oldham ring. The Oldham ring is a member that prevents the movable scroll 32 from rotating and allows the movable scroll 32 to orbit. The eccentric portion 51 is inserted into the boss portion 32*c*, and when the crankshaft 50 coupled to the movable scroll 32 rotates, the movable scroll 32 orbits without rotating with respect to the fixed scroll 31 so that the refrigerant in the compression chamber Sc is compressed.

(2-2-3) Housing

The housing 33 is press-fitted into the tubular member 21 of the casing 20, and the outer circumferential surface of the housing 33 is secured all the way around to the inner circumferential surface of the tubular member 21. The fixed scroll 31 is disposed above the housing 33 in such a way that the upper surface of the housing 33 and the lower surface of the peripheral portion 31*c* are in tight contact with each other (see FIG. 1). The housing 33 and the fixed scroll 31 are secured to each other by non-illustrated bolts or the like. In the housing 33 is formed a refrigerant passageway (not shown in the drawings) that brings, to the space below the housing 33, the refrigerant that has been discharged from the compression chamber Sc of the compression mechanism 30 via the discharge port 31*aa* formed in the fixed-side end plate 31*a* and has passed through a refrigerant passageway (not shown in the drawings) formed in the fixed scroll 31.

A recess portion 33*a* is formed in the central upper portion of the housing 33 as shown in FIG. 1. The recess portion 33*a* is formed in a circular shape as viewed in plan. The boss portion 32*c* of the movable scroll 32, to which the eccentric portion 51 of the crankshaft 50 is coupled, is housed inside the recess portion 33*a*.

An upper bearing 35 that pivotally supports the crankshaft 50 is disposed in the lower portion of the housing 33 (below the recess portion 33*a*) (see FIG. 1). The upper bearing 35 includes a bearing housing 35*a*, which is formed integrally with the housing 33, and a bearing metal 35*b*, which is housed in the bearing housing 35*a* (see FIG. 1). The bearing metal 35*b* pivotally supports a main shaft 52 of the crankshaft 50 in such way that the main shaft 52 may freely rotate.

(2-3) Electric Motor

The electric motor 40 drives the compression mechanism 30. The electric motor 40 is disposed between the upper bearing 35 disposed in the housing 33 and the later-described lower bearing 90 (see FIG. 1).

The electric motor 40 mainly has a stator 41 and a rotor 42 (see FIG. 1).

The stator 41 is formed in the shape of a thick-walled open cylinder. The rotor 42 is housed via a slight gap (an air gap G) inside (the hollow portion of) the stator 41 (see FIG. 1).

The stator 41 is secured to the inner peripheral surface of the tubular member 21 of the casing 20. It should be noted that a core cut portion 41*a*, being cut out so as to be recessed toward the central portion in the radial direction, is formed in a part of the cylinder-shaped outer peripheral surface of the stator 41 (see FIG. 1). A refrigerant passageway 43, which communicates between the space above the stator 41 and the space below the stator 41, is formed between the core cut portion 41*a* of the stator 41 and the tubular member 21 (see FIG. 1).

The rotor 42 is housed, in such a way that it may freely rotate, in the hollow portion of the stator 41. A central hole 42*a* for inserting the main shaft 52 of the crankshaft 50 is formed in the central portion of the rotor 42 (see FIG. 1). The main shaft 52 of the crankshaft 50 is inserted into the central hole 42*a* in the rotor 42. The rotor 42 is coupled to the crankshaft 50 by shrink fitting.

Furthermore, plural holes 42*b* that extend in the axial direction of the crankshaft 50 and go vertically through the rotor 42 are formed in the rotor 42.

The rotor 42 is coupled to the movable scroll 32 via the crankshaft 50. When the rotor 42 rotates, the movable scroll 32 orbits with respect to the fixed scroll 31.

(2-4) Crankshaft

The crankshaft 50 is a transmission shaft that transmits the driving force of the electric motor 40 to the movable scroll 32. The crankshaft 50 is disposed so as to extend in the vertical direction along the axial center of the tubular member 21 of the casing 20, and couples the rotor 42 of the electric motor 40 and the movable scroll 32 of the compression mechanism 30 to each other (see FIG. 1).

The crankshaft 50 has the main shaft 52, whose central axis coincides with the axial center of the tubular member 21, and the eccentric portion 51, which is eccentric with respect to the axial center of the tubular member 21 (see FIG. 1). An oil flow path 53 is formed inside the crankshaft 50 (see FIG. 1).

The crankshaft 50 is formed integrally with the upper counterweight 60 (see FIG. 1) and a disc 71 of the oil outflow reduction member 70 (see FIG. 2), which will be described later. The upper counterweight 60 and the disc 71 are disposed between the housing 33 of the compression mechanism 30 and the rotor 42 of the electric motor 40 in the axial direction of the crankshaft 50 (the vertical direction). The upper counterweight 60 and the disc 71 will be described later.

The eccentric portion 51 is disposed on the upper end of the main shaft 52 and is coupled to the boss portion 32*c* of the movable scroll 32.

The main shaft 52 is pivotally supported, in such a way that it may freely rotate, by the upper bearing 35 provided in the housing 33 and the later-described lower bearing 90. Furthermore, the main shaft 52 is coupled, between the upper bearing 35 and the lower bearing 90, to the rotor 42 of the electric motor 40.

The oil flow path 53 is a flow path for the refrigerating machine oil L which is used for supplying the refrigerating machine oil L for lubrication to sliding parts of the scroll compressor 10. The oil flow path 53 extends from the lower end to the upper end of the crankshaft 50 in the axial direction of the crankshaft 50 and opens at the upper and lower end portions of the crankshaft 50. The lower end of the crankshaft 50 is disposed in the oil collection space 25, and the refrigerating machine oil L in the oil collection space 25 is carried from the opening on the lower end side to the opening on the upper end side of the oil flow path 53. The refrigerating machine oil L having flowed through the oil flow path 53 flows through a non-illustrated oil passageway communicated to the oil flow path 53 and is supplied to the sliding parts of the scroll compressor 10.

It should be noted that the refrigerating machine oil L that has been supplied to the sliding parts of the scroll compressor 10 is returned to the oil collection space 25.

For example, some of the refrigerating machine oil L that has slid the sliding parts of the compression mechanism 30 flows into the compression chamber Sc and, together with high-pressure refrigerant that has been compressed, flows into the space below the housing 33. The high-pressure gas refrigerant having the refrigerating machine oil L mixed therein descends through the refrigerant passageway 43 formed between the stator 41 and the tubular member 21 and collides with an oil separation plate 91 secured to a bearing housing 90*a* of the later-described lower bearing 90. When the refrigerant having the refrigerating machine oil L mixed therein collides with the oil separation plate 91, the refrigerating machine oil L is separated from the refrigerant. The refrigerating machine oil L that is separated from the refrigerant flows into the oil collection space 25 from a non-illustrated opening formed in the oil separation plate 91. Furthermore, for example, the refrigerating machine oil L that has lubricated the sliding part of the crankshaft 50 and the boss portion 32*c* and the sliding part of the crankshaft 50 and the upper bearing 35 leaks out to the space below the housing 33, falls, and returns to the oil collection space 25. Furthermore, for example, the refrigerating machine oil L that has lubricated the sliding parts of the crankshaft 50 and the lower bearing 90 also falls and returns to the oil collection space 25.

(2-5) Upper Counterweight

The upper counterweight 60 is used together with the later-described lower counterweight 80 to eliminate imbalances in the mass distribution of rotating bodies including the rotor 42 of the electric motor 40 and the crankshaft 50 and reduce vibration of the rotating bodies. By reducing vibration of the rotating bodies, effects such as controlling the occurrence of noise, keeping the life of the upper bearing 35 and the lower bearing 90 from decreasing, and keeping the efficiency of the scroll compressor 10 from dropping are obtained.

The upper counterweight 60 is disposed above the rotor 42 (see FIG. 1). The upper counterweight 60 is disposed adjacent to the rotor 42 (see FIG. 1). Furthermore, the upper counterweight 60 is disposed below the housing 33 and adjacent to the housing 33 (see FIG. 1).

As shown in FIG. 3, the upper counterweight 60 is formed in a semi-annular shape centered on a center O of the main shaft 52 of the crankshaft 50 as viewed from above. Furthermore, the upper counterweight 60 extends in the axial direction of the crankshaft 50 as viewed from the side. That is to say, the upper counterweight 60 is formed in the shape of a half hollow cylinder extending in the axial direction of the crankshaft 50. The main shaft 52 of the crankshaft 50 is disposed in the hollow portion of the upper counterweight 60 shaped like a half hollow cylinder.

The upper counterweight 60 is formed integrally with the crankshaft 50. That is to say, the upper counterweight 60 is integrated with the crankshaft 50. The upper counterweight 60 rotates integrally with the crankshaft 50 when the rotor 42 coupled to the crankshaft 50 rotates. Here, the space through which at least part of the upper counterweight 60 passes when the crankshaft 50 rotates 360° is called a counterweight passing space Sbw (see FIG. 1).

Furthermore, the upper counterweight 60 is also formed integrally with the disc 71 of the later-described oil outflow reduction member 70. The upper counterweight 60 is disposed so as to extend upward from the upper surface of the disc 71. It should be noted that a radius R1 (see FIG. 3) of the outer periphery of the upper counterweight 60 whose outer shape is formed in a semicircular shape and a radius R2 (see FIG. 3) of the outer periphery of the disc 71 are identical.

The cover 72 of the later-described oil outflow reduction member 70 is attached by a bolt 73 to the upper portion of the upper counterweight 60 (see FIG. 2).

With a configuration that the disc 71 being disposed below the upper counterweight 60 and the cover 72 being attached to the upper counterweight 60, the counterweight passing space Sbw through which the upper counterweight 60 passes when the crankshaft 50 rotates is enclosed on its lower side by the disc 71 and on its lateral side and upper side by the cover 72.

(2-6) Oil Outflow Reduction Member

The oil outflow reduction member 70 is a member for reducing oil outflow. The oil outflow reduction member 70 may be a magnetic body or a nonmagnetic body.

Mist of the refrigerating machine oil L, which is separated when the gas refrigerant collides with the oil separation plate 91, and droplets of the refrigerating machine oil L, which fall inside the scroll compressor 10 after lubricating the upper bearing 35, are present in the space below the rotor 42. The oil outflow reduction member 70 is a member for keeping the mist and the like of the refrigerating machine oil L from being transported, through the holes 42*b* formed in the rotor 42 and the air gap G between the rotor 42 and the stator 41, from the space below the rotor 42 to the space above the rotor 42 and flowing out together with the gas refrigerant from the discharge pipe 42 to the outside of the scroll compressor 10.

The oil outflow reduction member 70 encloses the upper side, lower side, and lateral side of the counterweight passing space Sbw through which at least part of the upper counterweight 60 passes when the crankshaft 50 rotates 360°.

The oil outflow reduction member 70 mainly has the disc 71 and the cover 72 (see FIG. 2).

The disc 71 is formed in a circular shape centered on the center O of the main shaft 52 of the crankshaft 50 as viewed in plan (see FIG. 3). The disc 71 is formed integrally with the main shaft 52 of the crankshaft 50. The main shaft 52 extends in the vertical direction so as to be orthogonal to the plane of the disc 71 and goes through the central portion of the disc 71 (see FIG. 2 and FIG. 3). The disc 71 encloses the counterweight passing space Sbw at the side of the rotor 42 of the electric motor 40. In other words, the disc 71 encloses the lower side of the counterweight passing space Sbw. The radius R2 (see FIG. 3) of the outer periphery of the disc 71 is identical to the radius R1 (see FIG. 3) of the outer periphery of the upper counterweight 60 whose outer shape is formed in a semi-circular shape. Furthermore, the diameter of the disc 71 that is, an outer diameter D3 (see FIG. 2) of the disc 71—is larger than the diameter of the rotor 42 that is, an outer diameter D2 (see FIG. 1) of the rotor 42 which is formed in the shape of a cylinder. At the same time, the outer diameter D3 (see FIG. 2) of the disc 71 is smaller than the diameter of the hollow portion of the stator 41 in which the rotor 42 is housed. In other words, the outer diameter D3 of the disc 71 is smaller than an inner diameter D1 (see FIG. 1) of the stator 41.

The cover 72 encloses the upper side and lateral side of the counterweight passing space Sbw. In other words, the cover 72 encloses the lateral side of the counterweight passing space Sbw and the side (the housing 33 side) of the counterweight passing space Sbw distal from the rotor 42 in the axial direction of the crankshaft 50.

The cover 72 includes an upper disc portion 72*a* and a lateral portion 72*b* (see FIG. 2) The upper disc portion 72*a* is formed in the shape of a thin disc. A hole 72*aa*, into which the main shaft 52 of the crankshaft 50 is inserted, is formed in the central portion of the upper disc portion 72*a* (see FIG. 1). The cover 72 is, in a state in which the main shaft 52 is inserted into the hole 72*aa* of the upper disc portion 72*a*, secured by the bolt 73 to the upper portion of the upper counterweight 60 formed integrally with the crankshaft 50 (see FIG. 2). The upper disc portion 72*a* encloses the side (the housing 33 side) of the counterweight passing space Sbw distal from the rotor 42 in the axial direction of the crankshaft 50. That is to say, the upper disc portion 72*a* encloses the upper side of the counterweight passing space Sbw.

The lateral portion 72*b* of the cover 72 secured to the upper counterweight 60 extends from the peripheral edge of the upper disc portion 72*a* along the axial direction of the crankshaft 50 toward the rotor 42 (see FIG. 2). That is to say, the lateral portion 72*b* of the cover 72 secured to the upper counterweight 60 extends downward from the peripheral edge of the upper disc portion 72*a*. The lateral portion 72*b* is formed in the shape of a thin-walled open cylinder extending along the axial direction of the crankshaft 50. The lateral portion 72*b* covers the lateral side of the counterweight passing space Sbw.

The cover 72 is basically designed in such a way that the inner peripheral surface of the lateral portion 72*b* and the outer peripheral surface of the disc 71 are in tight contact with each other so that a gap is not formed between them in a state in which the cover 72 is secured to the upper counterweight 60. However, the cover 72 is designed in such a way that, in one section in the circumferential direction of the lateral portion 72*b*, a gap C is formed between the inner peripheral surface of the lateral portion 72*b* and the outer peripheral surface of the disc 71 (see FIG. 2). The gap C formed between the inner peripheral surface of the lateral portion 72*b* and the outer peripheral surface of the disc 71 is provided in order to expel, to the outside, the refrigerating machine oil L that has flowed into the counterweight passing space Sbw (inside the oil outflow reduction member 70) through, for example, a small gap between the hole 72*aa* formed in the central portion of the upper disc portion 72*a* and the main shaft 52 of the crankshaft 50 inserted into this hole 72*aa*.

The overall outer shape of the oil outflow reduction member 70 is formed in the shape of a cylinder extending in the axial direction of the crankshaft 50 by the disc 71 that is disposed on the lower side (the rotor 42 side) of the counterweight passing space Sbw, the upper disc portion 72*a* that is shaped like a disc and is disposed on the upper side (the housing 33 side) of the counterweight passing space Sbw, and the lateral portion 72*b* that is shaped like a hollow cylinder.

The oil outflow reduction member 70 rotates integrally with the crankshaft 50, because the disc 71 is formed integrally with the crankshaft 50 and the cover 72 is secured to the upper counterweight 60 formed integrally with the crankshaft 50.

(2-7) Lower Counterweight

The lower counterweight 80 is, as described above, used together with the upper counterweight 60 to eliminate imbalances in the mass distribution of the rotating bodies including the rotor 42 of the electric motor 40 and the crankshaft 50 and reduce vibration of the rotating bodies.

The lower counterweight 80 is secured to the lower portion of the rotor 42 (see FIG. 1). That is to say, the lower counterweight 80 is disposed below the rotor 42. Furthermore, the lower counterweight 80 is disposed above the lower bearing 90.

(2-8) Lower Bearing

The lower bearing 90 is a bearing that pivotally supports the crankshaft 50, and is disposed below the electric motor 40 (see FIG. 1). The lower bearing 90 includes the bearing housing 90*a*, which is secured to the tubular member 21 of the casing 20, and a bearing metal 90*b*, which is housed inside the bearing housing 90*a*. The bearing metal 90*b* pivotally supports the main shaft 52 of the crankshaft 50 in such a way that the main shaft 52 may freely rotate. Furthermore, the oil separation plate 91 is secured to the bearing housing 90*a* of the lower bearing 90.

(3) Description of Operation of Scroll Compressor

The operation of the scroll compressor 10 will be described.

When the electric motor 40 is driven, the rotor 42 rotates and the crankshaft 50 coupled to the rotor 42 rotates. When the crankshaft 50 rotates, the movable scroll 32 is driven. The movable scroll 32 orbits with respect to the fixed scroll 31 without rotating, due to the working of the non-illustrated Oldham ring.

As the movable scroll 32 orbits, the volume of the compression chamber Sc of the compression mechanism 30 periodically changes. When the volume of the compression chamber Sc increases, the low-pressure gas refrigerant is supplied through the suction pipe 23 to the compression chamber Sc. More specifically, when the volume of the compression chamber Sc on the most peripheral edge side increases, the low-pressure gas refrigerant supplied from the suction pipe 23 is supplied to the compression chamber Sc on the most peripheral edge side. On the other hand, when the volume of the compression chamber Sc decreases, the gas refrigerant is compressed inside the compression chamber Sc and eventually becomes the high-pressure gas refrigerant. The high-pressure gas refrigerant is discharged from the discharge port 31*aa* positioned in the vicinity of the center of the upper surface of the fixed scroll 31. The high-pressure gas refrigerant that has been discharged from the discharge port 31*aa* passes through the non-illustrated refrigerant passageways formed in the fixed scroll 31 and in the housing 33 and flows into the space below the housing 33. The high-pressure gas refrigerant that has been compressed by the compression mechanism 30 is eventually discharged from the discharge pipe 24 to the outside of the scroll compressor 10.

(4) Characteristics (4-1)

The scroll compressor 10 of the present embodiment is equipped with the crankshaft 50, the electric motor 40, the upper counterweight 60 serving as an example of a counterweight, and the oil outflow reduction member 70. The electric motor 40 has the rotor 42 coupled to the crankshaft 50 and the stator 41 in which the rotor 42 is housed via the air gap G The upper counterweight 60 is disposed adjacent to the rotor 42 and is integrated with the crankshaft 50. The oil outflow reduction member 70 encloses the upper side, lower side, and lateral side of the counterweight passing space Sbw that is a space through which at least part of the upper counterweight 60 passes when the crankshaft 50 rotates 360°.

Here, as the counterweight passing space Sbw is enclosed by the oil outflow reduction member 70, a movement of the refrigerating machine oil L is hardly caused by a pressure difference around the upper counterweight 60, which arises from the rotation of the upper counterweight 60, in the passageways (the air gap G between the stator 41 and the rotor 42, the holes 42*b* going through the rotor 42 in the vertical direction, etc.) communicating between the space below the rotor 42 and the space above the rotor 42. Furthermore, here, as the counterweight passing space Sbw is enclosed by the oil outflow reduction member 70, it is difficult for the refrigerating machine oil to be collected in the counterweight passing space Sbw. For these reasons, it is easy for the oil outflow caused by the counterweight to be reduced.

(4-2)

In the scroll compressor 10 of the present embodiment, the oil outflow reduction member 70 rotates integrally with the crankshaft 50.

Here, as the oil outflow reduction member 70 is a structure that rotates integrally with the crankshaft 50, it is easy to enclose the counterweight passing space Sbw with the oil outflow reduction member 70, and it is difficult for a pressure difference to occur around the upper counterweight 60. For this reason, it is easy for the oil outflow caused by the upper counterweight 60 to be reduced.

(4-3)

In the scroll compressor 10 of the present embodiment, the oil outflow reduction member 70 is formed in the shape of a cylinder extending in the axial direction of the crankshaft 50.

Here, as the outer shape of the oil outflow reduction member 70 is formed in the shape of a cylinder extending in the axial direction of the crankshaft 50, even when the oil outflow reduction member 70 rotates together with the crankshaft 50, it is difficult for a pressure difference to arise around the oil outflow reduction member 70. For this reason, it is easy for the oil outflow to be reduced.

(4-4)

In the scroll compressor 10 of the present embodiment, the oil outflow reduction member 70 includes the disc 71 which encloses the rotor 42 side of the counterweight passing space Sbw. The upper counterweight 60 and the disc 71 are formed integrally with the crankshaft 50.

Here, as the disc 71 on the rotor 42 side of the oil outflow reduction member 70 and the upper counterweight 60 are formed integrally with the crankshaft 50, the number of parts can be reduced.

(4-5)

In the scroll compressor 10 of the present embodiment, the oil outflow reduction member 70 includes the cover 72. The cover 72 encloses the lateral side of the counterweight passing space Sbw and the side of the counterweight passing space Sbw distal from the rotor 42 in the axial direction of the crankshaft 50.

Here, as the cover 72 is manufactured as a separate member, it is easy for the production of the oil outflow reduction member 70 to be made easier compared to a case where the oil outflow reduction member 70 is integrally formed.

(4-6)

In the scroll compressor 10 of the present embodiment, the upper counterweight 60 is disposed above the rotor 42. The gap C is formed between the disc 71 and the cover 72 in at least part of the area between them.

Here, as the gap C is formed between the disc 71 and the cover 72, even if the refrigerating machine oil L enters the counterweight passing space Sbw (the space inside the oil outflow reduction member 70) from a gap between the cover 72 and the crankshaft 50, the refrigerating machine oil L can be expelled. Therefore, imbalances arising as a result of the refrigerating machine oil L being collected in the counterweight passing space Sbw can be prevented and a drop in the efficiency of the scroll compressor 10 can be prevented.

(4-7)

In the scroll compressor 10 of the present embodiment, the outer diameter D3 of the disc 71 is larger than the outer diameter D2 of the rotor 42 formed in the shape of a cylinder and is smaller than the inner diameter D1 of the stator 41 in which the rotor 42 is housed.

Here, as the outer diameter D3 of the disc 71 is larger than the outer diameter D2 of the rotor 42, when the refrigerating machine oil L in the counterweight passing space Sbw is expelled from the gap between the disc 71 and the cover 72, the expelled refrigerating machine oil L can be kept from being scattered by the flow of gas refrigerant and being carried together with the refrigerant gas to the outside of the scroll compressor 10. Furthermore, as the outer diameter D3 of the disc 71 is smaller than the inner diameter D1 of the stator 41, the crankshaft 50 having the oil outflow reduction member 70 attached thereto can be inserted into the inside of the stator 41 and the assembling work of the scroll compressor 10 is not hindered because of the presence of the disc 71.

(4-8)

In the scroll compressor 10 of the present embodiment, the radius R2 of the disc 71 is identical to the radius R1 of the upper counterweight 60 formed in a semicircular shape.

Here, as the radius R2 of the disc 71 of the oil outflow reduction member 70 and the radius R1 of the upper counterweight 60 are formed identical to each other, it is difficult for a pressure difference around the rotating bodies to occur.

Second Embodiment

A scroll compressor 110 pertaining to a second embodiment of the present invention will be described.

Figure 4:
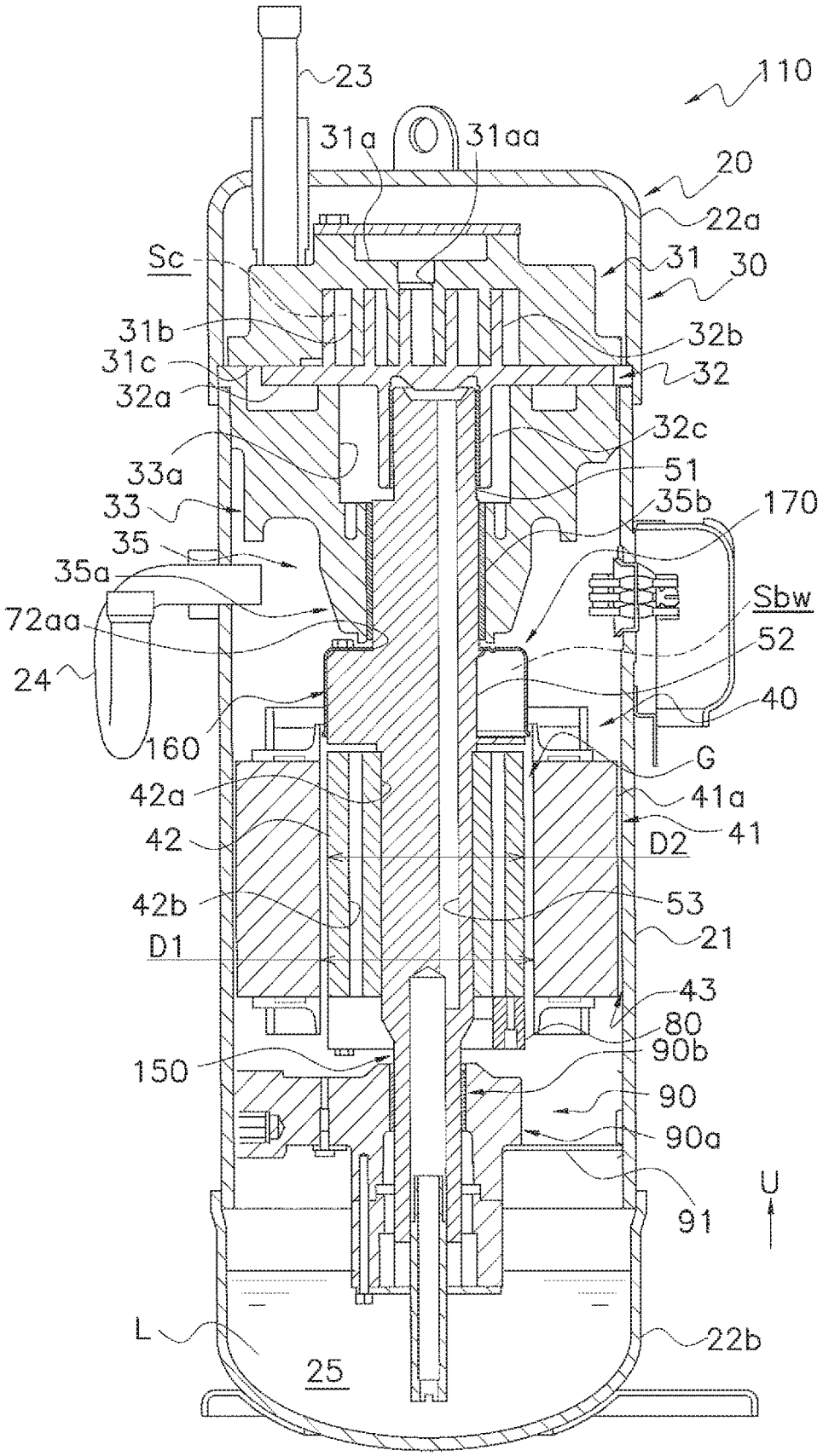
FIG. 4 is a general longitudinal sectional view of a scroll compressor pertaining to a second embodiment of the present invention.
Figure 5:
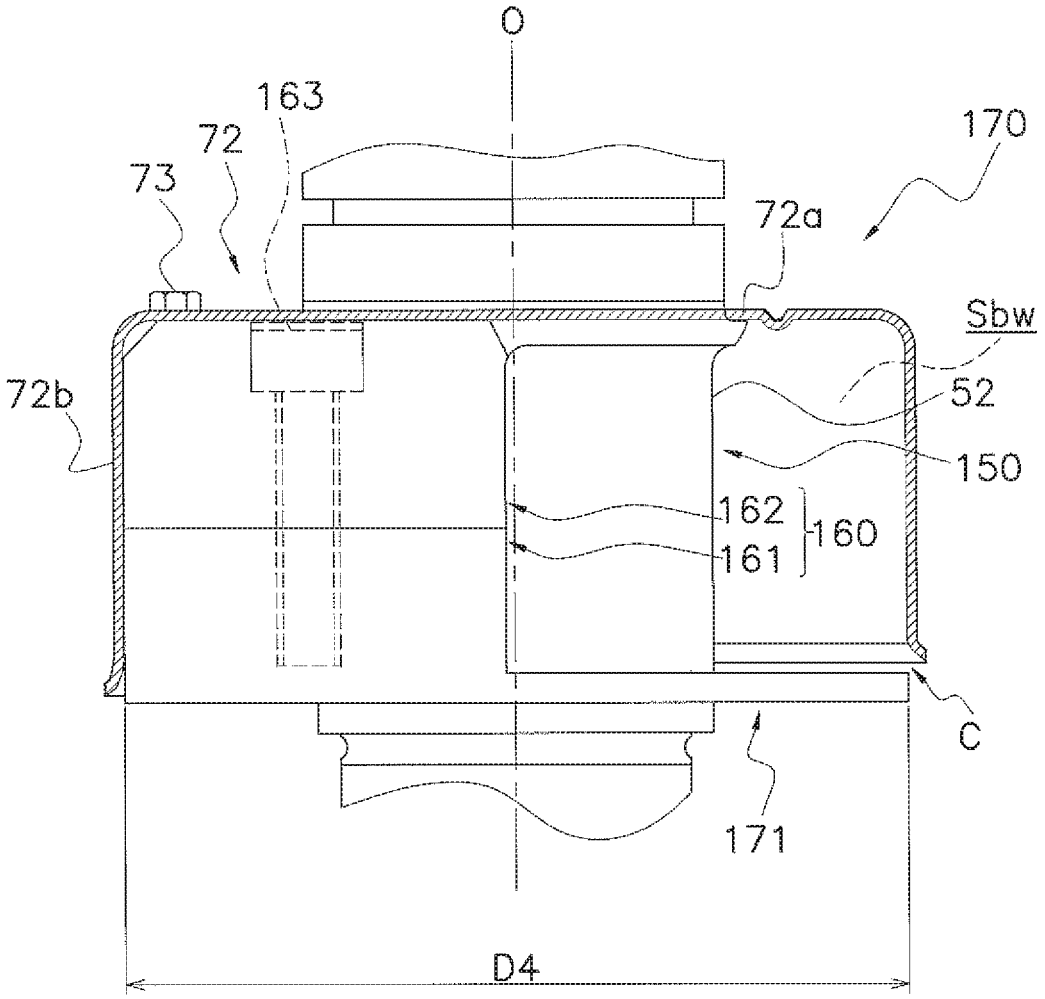
FIG. 5 is an enlarged view of the area around an upper counterweight of the scroll compressor of FIG. 4.
Figure 6:
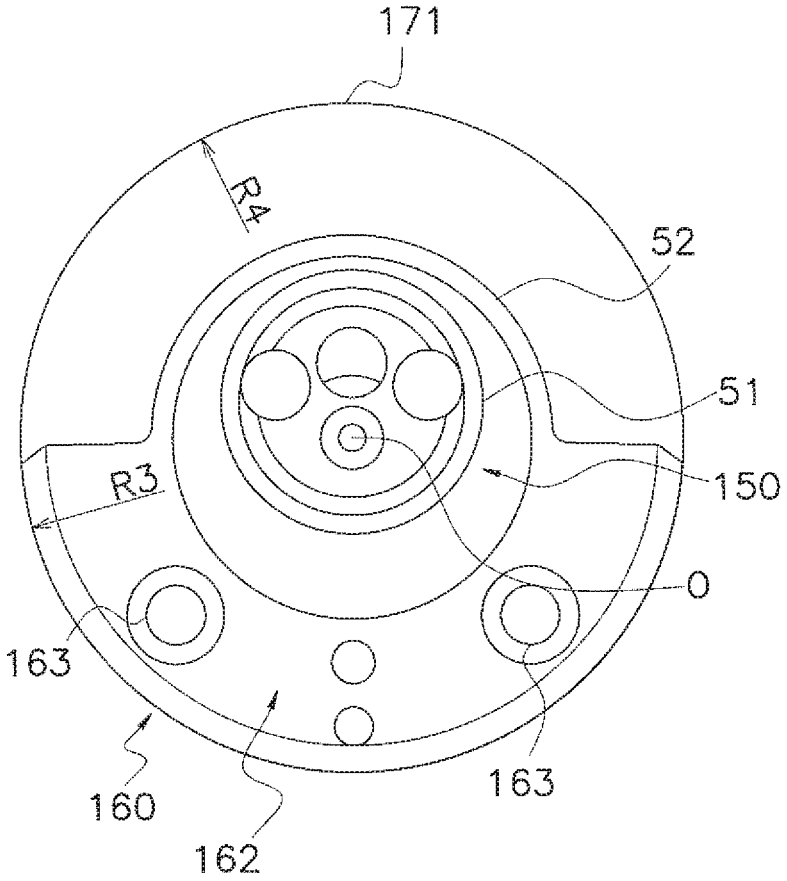
FIG. 6 is a plan view in which the crankshaft and the upper counterweight of the scroll compressor of FIG. 4 are viewed from above in a state in which the cover of the oil outflow reduction member is detached.

FIG. 4 is a general longitudinal sectional view of the scroll compressor 110 pertaining to the second embodiment. FIG. 5 is an enlarged view of the area around a later-described upper counterweight 160 of the scroll compressor 110. FIG. 5 depicts a state in which the cover 72 of a later-described oil outflow reduction member 170 is cut by a plane extending in the axial direction of a crankshaft 150. FIG. 6 is a plan view in which the crankshaft 150 and the upper counterweight 160 of the scroll compressor 110 are viewed from above in a state in which the cover 72 of the oil outflow reduction member 170 is detached.

The scroll compressor 110 pertaining to the second embodiment is the same as the scroll compressor 10 pertaining to the first embodiment except for the crankshaft 150, the upper counterweight 160, and the oil outflow reduction member 170 (see FIG. 4). Here, the crankshaft 150, the upper counterweight 160, and the oil outflow reduction member 170, which are different from the scroll compressor 10, will be described, and description regarding other parts will be omitted.

(1) Detailed Configuration

Details regarding the crankshaft 150, the upper counterweight 160, and the oil outflow reduction member 170 will be described below. It should be noted that the crankshaft 150, the upper counterweight 160, and the oil outflow reduction member 170 have many of the same points as the crankshaft 50, the upper counterweight 60, and the oil outflow reduction member 70 of the scroll compressor 10 of the first embodiment, so mainly their points of difference will be described.

(1-1) Crankshaft

The crankshaft 150 differs from the crankshaft 50 of the first embodiment in that it is formed integrally with only part of the later-described upper counterweight 160 rather than with the entire upper counterweight 160. Furthermore, the crankshaft 150 differs from the crankshaft 50 of the first embodiment in that it is not formed integrally with a disc 171 of the later-described oil outflow reduction member 170.

Except for these points the crankshaft 150 is the same as the crankshaft 50 of the first embodiment, so other description will be omitted.

(1-2) Upper Counterweight

The upper counterweight 160 is, like the upper counterweight 60 of the first embodiment, used together with the lower counterweight 80 to eliminate imbalances in the mass distribution of rotating bodies including the rotor 42 of the electric motor 40 and the crankshaft 150 and reduce vibration of the rotating bodies.

The upper counterweight 160 is, like the upper counterweight 60 of the first embodiment, disposed adjacent to the rotor 42 (see FIG. 4). The upper counterweight 160 is disposed above the rotor 42 of the electric motor 40 (see FIG. 4). Furthermore, the upper counterweight 160 is, like the upper counterweight 60 of the first embodiment, disposed below the housing 33 and adjacent to the housing 33 (see FIG. 4).

The upper counterweight 160 mainly differs from the upper counterweight 60 of the first embodiment in that it is divided (divided in two into a first counterweight 161 and a second counterweight 162) in the axial direction of the crankshaft 150 (see FIG. 5). The upper counterweight 160 configured from the first counterweight 161 and the second counterweight 162 is, like the upper counterweight 60 of the first embodiment, formed in the shape of a hollow half cylinder extending in the axial direction of the crankshaft 150 (see FIG. 5 and FIG. 6). That is to say, the upper counterweight 160 is, like the upper counterweight 60 of the first embodiment, formed in a semi-annular shape centered on the center O of the main shaft 52 of the crankshaft 150 when viewed from above (see FIG. 5). The main shaft 52 of the crankshaft 150 is disposed in the hollow portion of the upper counterweight 160 shaped like a hollow half cylinder (see FIG. 6).

The first counterweight 161 is disposed closer to the rotor 42 of the electric motor 40 than the second counterweight 162 (see FIG. 5). The first counterweight 161 is formed in the shape of a hollow half cylinder extending in the axial direction of the crankshaft 150. The first counterweight 161 is formed in a semi-annular shape centered on the center O of the main shaft 52 of the crankshaft 150 when viewed from above.

The first counterweight 161 is not formed integrally with the crankshaft 150. The first counterweight 161 is coupled by bolts 163 to the second counterweight 162, which is formed integrally with the crankshaft 150 (see FIG. 5) as described later. The bolts 163 are an example of a fastening member. Here, the second counterweight 162, which is formed integrally with the crankshaft 150, and the first counterweight 161 are secured to each other by the bolts 163, so the entire upper counterweight 160 is integrated with the crankshaft 150.

The first counterweight 161 is formed integrally with the disc 171 of the later-described oil outflow reduction member 170. A hole (not shown in the drawings) for inserting the main shaft 52 of the crankshaft 150 is formed in the central portion of the disc 171. The first counterweight 161 and the second counterweight 162 are secured to each other by the bolts 163 in a state in which the main shaft 52 is inserted into the hole in the central portion of the disc 171. The first counterweight 161 is secured to the second counterweight 162 in a posture in which the first counterweight 161 extends upward along the axial direction of the crankshaft 150 from the upper surface of the disc 171 (see FIG. 5).

The second counterweight 162 is disposed more distant from the rotor 42 side of the electric motor 40—that is to say, the housing 33 side—than the first counterweight 161 (see FIG. 5). The second counterweight 162 is formed integrally with the main shaft 52 of the crankshaft 150. The second counterweight 162 is formed in the shape of a hollow half cylinder extending in the axial direction of the crankshaft 150. The second counterweight 162 is formed in a semi-annular shape centered on the center O of the main shaft 52 of the crankshaft 150 when viewed from above (see FIG. 6).

Holes for inserting the bolts 163 are formed in two places in the upper surface of the second counterweight 162. The first counterweight 161 and the second counterweight 162 are coupled to each other by inserting the bolts 163 from above into the holes formed in the upper surface of the second counterweight 162 and screwing the bolts 163 into screw holes formed in the first counterweight 161 (see FIG. 5). The bolts 163 are screwed into the first counterweight 161 in such a way that they do not project on the rotor 42 side beyond the disc 171, or in other words to the extent that they do not go through the disc 171 (see FIG. 5).

It should be noted that the radius of the outer periphery of the second counterweight 162 shaped like a hollow half cylinder is identical to the radius of the outer periphery of the first counterweight 161 shaped like a hollow half cylinder. Furthermore, a radius R3 (see FIG. 6) of the outer periphery of the upper counterweight 160—that is, the radius of the outer peripheries of the first counterweight 161 and second counterweight 162 that are shaped like a hollow half cylinder is identical to a radius R4 (see FIG. 6) of the outer periphery of the later-described disc 171.

Like the upper counterweight 60 of the first embodiment, the cover 72 of the oil outflow reduction member 170 is attached by the bolt 73 to the upper portion of the upper counterweight 160 (the upper portion of the second counterweight 162) (see FIG. 5).

The disc 171 is disposed below the upper counterweight 160 (the first counterweight 161 is formed integrally with the disc 171), and the cover 72 is attached to the upper portion of the upper counterweight 160; thus, the counterweight passing space Sbw is enclosed on its lower side by the disc 171 and on its lateral and upper sides by the cover 72 (see FIG. 4). It should be noted that the counterweight passing space Sbw is, like in the first embodiment, a space through which at least part of the upper counterweight 160 passes when the crankshaft 150 rotates 360°.

(1-3) Oil Outflow Reduction Member

The oil outflow reduction member 170 is a member for reducing oil outflow. The oil outflow reduction member 170 may be a magnetic body or a nonmagnetic body.

The oil outflow reduction member 170, like the oil outflow reduction member 70 pertaining to the first embodiment, encloses the upper side, lower side, and lateral side of the counterweight passing space Sbw through which at least part of the upper counterweight 160 passes when the crankshaft 150 rotates 360°.

The oil outflow reduction member 170, like the oil outflow reduction member 70 of the first embodiment, mainly has the disc 171 and the cover 72 (see FIG. 5). The oil outflow reduction member 170 differs from the oil outflow reduction member 70 of the first embodiment in that the disc 171 is not formed integrally with the crankshaft 150.

The disc 171 is an annular flat plate in the central portion of which is formed a hole (not shown in the drawings) for inserting the main shaft 52 of the crankshaft 150. The disc 171 is formed integrally with the first counterweight 161 of the upper counterweight 160 (see FIG. 5). In a state in which the first counterweight 161 formed integrally with the disc 171 is secured to the second counterweight 162, the disc 171 is formed in an annular shape centered on the center O of the main shaft 52 of the crankshaft 150 as viewed in plan (see FIG. 6). Furthermore, in a state in which the first counterweight 161 is secured to the second counterweight 162, the main shaft 52 extends in the vertical direction so as be orthogonal to the plane of the disc 171 and goes through the central portion of the disc 171 (see FIG. 5 and FIG. 6). The disc 171 encloses the counterweight passing space Sbw at the rotor 42 side of the electric motor 40. In other words, the disc 171 encloses the lower side of the counterweight passing space Sbw.

It should be noted that the radius R4 (see FIG. 6) of the outer periphery of the disc 171 is identical to the radius R3 (see FIG. 6) of the upper counterweight 160 shaped like a hollow half cylinder. Furthermore, the diameter of the disc 171—that is, an outer diameter D4 (see FIG. 5) of the disc 171—is identical to the diameter of the rotor 42—that is, the outer diameter D2 (see FIG. 4) of the rotor 42 which is formed in the shape of an cylinder. The disc 171 is the same as the disc 71 of the oil outflow reduction member 70 of the first embodiment regarding other points, so description will be omitted.

The cover 72 of the oil outflow reduction member 170 is the same as the cover 72 of the oil outflow reduction member 70 of the first embodiment, so description will be omitted.

The overall outer shape of the oil outflow reduction member 170 is formed in the shape of a cylinder extending in the axial direction of the crankshaft 150 by the disc 171 that is disposed on the lower side (the rotor 42 side) of the counterweight passing space Sbw, the upper disc portion 72*a* of the cover 72 that is shaped like a disc and is disposed on the upper side (the housing 33 side) of the counterweight passing space Sbw, and the lateral portion 72*b* of the cover 72 that is shaped like a hollow cylinder.

The oil outflow reduction member 170 rotates integrally with the crankshaft 50, because the first counterweight 161 formed integrally with the disc 171 is coupled to the second counterweight 162 formed integrally with the crankshaft 150 and the cover 72 is secured to the second counterweight 162 formed integrally with the crankshaft 50.

(2) Characteristics

The scroll compressor 110 of the second embodiment has the same characteristics as those of (4-1), (4-2), (4-3), (4-5), (4-6), and (4-8) given as characteristics of the scroll compressor 10 in the first embodiment.

In addition, the scroll compressor 110 of the second embodiment has the following characteristics.

(2-1)

In the scroll compressor 110 of the present embodiment, the oil outflow reduction member 170 includes the disc 171 that encloses the rotor 42 side of the counterweight passing space Sbw. The disc 171 is formed in an annular shape and is formed as a member separate from the crankshaft 150.

Here, as the disc 171 on the rotor 42 side of the oil outflow reduction member 170 is formed as a member separate from the crankshaft 150, the shape of the crankshaft 150 can be made simpler and the process of manufacturing the crankshaft 150 can be made easier.

(2-2)

In the scroll compressor 110 of the present embodiment, the upper counterweight 160 includes the first counterweight 161 and the second counterweight 162. The first counterweight 161 is formed integrally with the disc 171 and is disposed on the rotor 42 side. The second counterweight 162 is formed integrally with the crankshaft 150 and is coupled to the first counterweight 161 by the bolts 163 serving as an example of a fastening member. The bolts 163 are disposed in such a way that they do not project on the rotor 42 side from the disc 171.

Here, as the bolts 163 which couple the first counterweight 161 and the second counterweight 162 to each other do not project on the rotor side 42 beyond the disc 171, it is easy to prevent that the refrigerating machine oil L mist becomes finer as a result of the refrigerant gas being agitated by the bolts 163 and the refrigerating machine oil L thereby easily flows out together with the refrigerant gas to the outside of the scroll compressor 110.

(2-3)

In the scroll compressor 110 of the present embodiment, the outer diameter D4 of the disc 171 is equal to or smaller than the outer diameter D2 of the rotor 42 formed in the shape of a cylinder. In particular, here, the outer diameter D4 of the disc 171 is identical to the outer diameter D2 of the rotor 42 formed in the shape of a cylinder.

Here, as the outer diameter D4 of the disc 171 of the oil outflow reduction member 170 is formed equal to or smaller than the outer diameter D2 of the rotor 42, it is easy to insert the crankshaft 150 having the oil outflow reduction member 170 attached thereto into the inside of the stator 41, and the assembly of the scroll compressor 110 can be made easier.

Third Embodiment

A scroll compressor 210 pertaining to a third embodiment of the present invention will be described.

Figure 7:
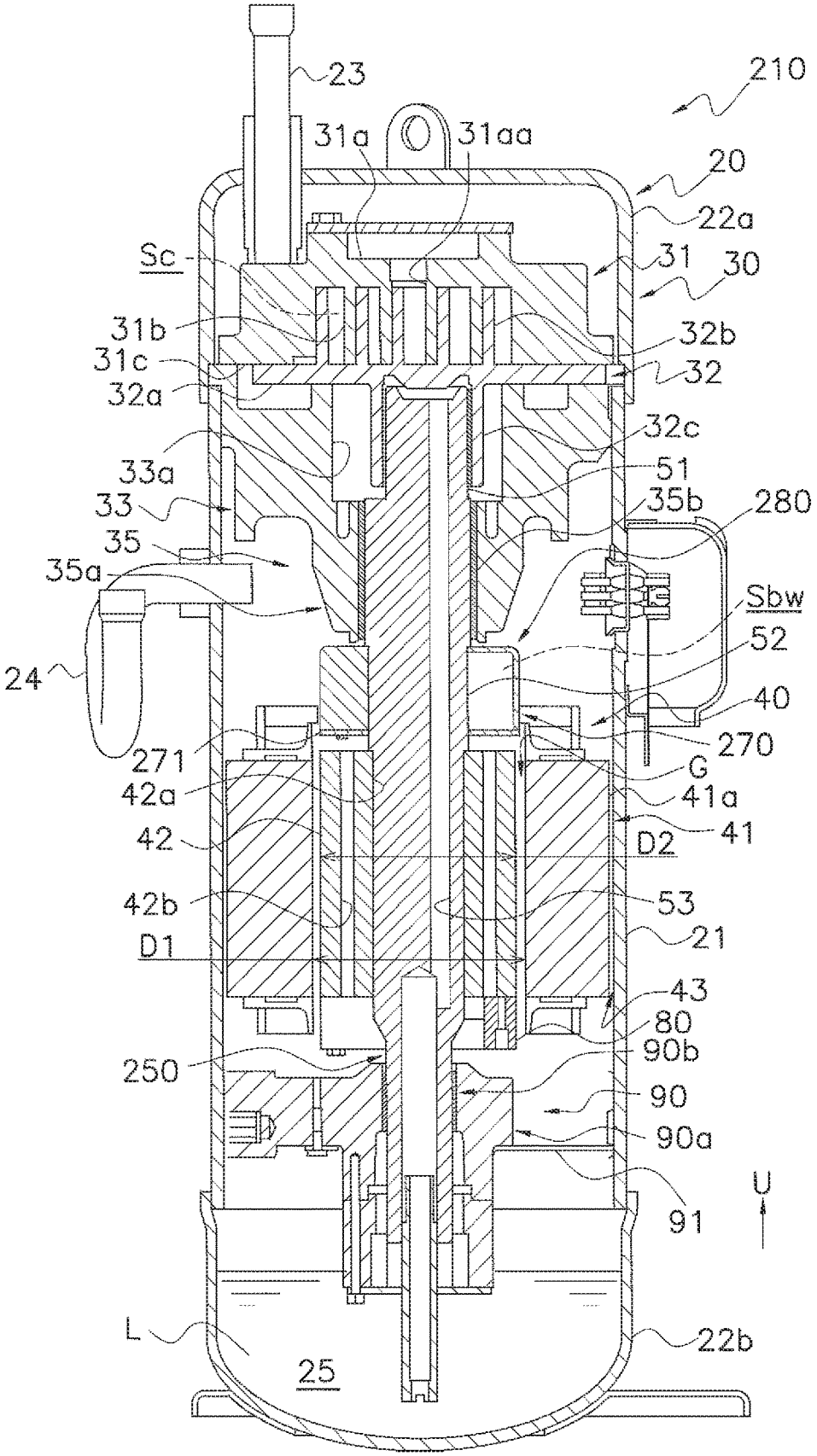
FIG. 7 is a general longitudinal sectional view of a scroll compressor pertaining to a third embodiment of the present invention.
Figure 8:
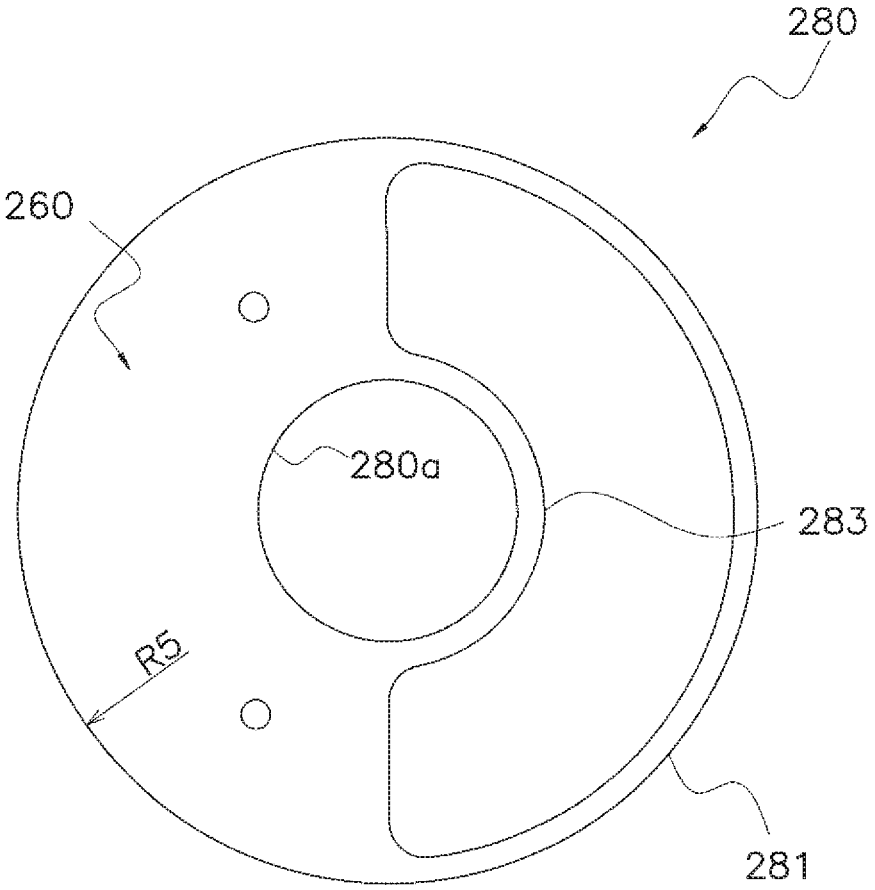
FIG. 8 is a plan view in which a cylinder member of the scroll compressor of FIG. 7 is viewed from below.
Figure 9:
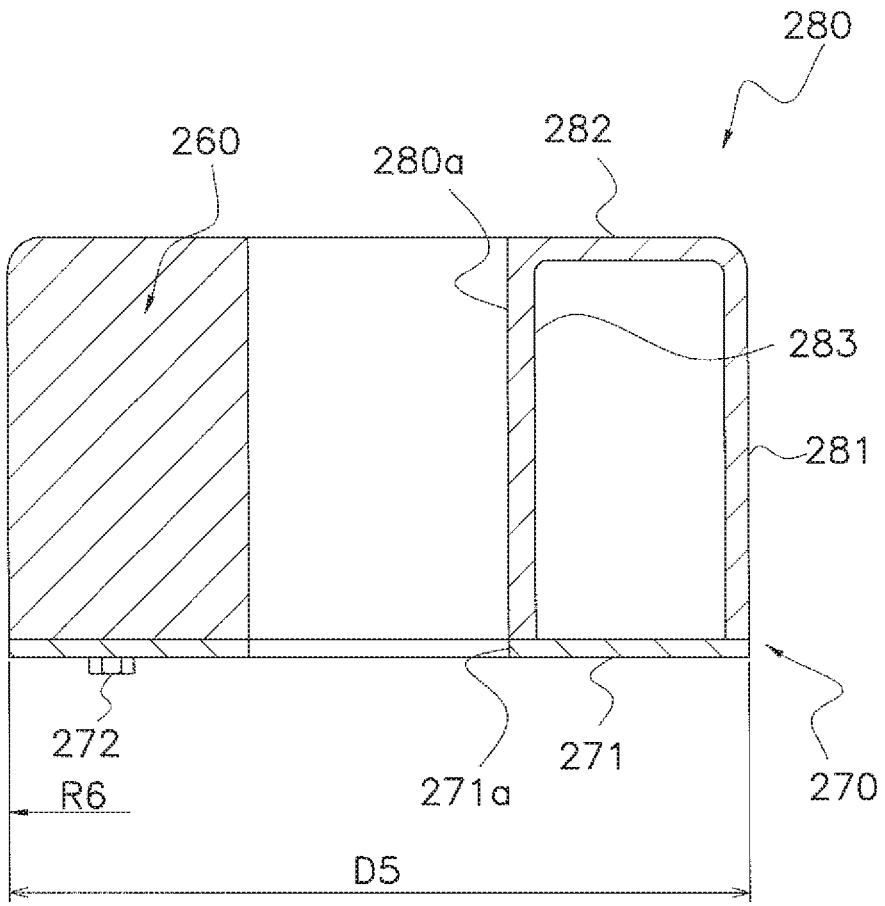
FIG. 9 is a longitudinal sectional view of the cylinder member of the scroll compressor of FIG. 7 and a disc attached to the cylinder member.

FIG. 7 is a general longitudinal sectional view of the scroll compressor 210 pertaining to the second embodiment. FIG. 8 is a drawing in which a later-described cylinder member 280 of the scroll compressor 210 is viewed from its lower side. FIG. 9 is a sectional view in which the cylinder member 280 and a later-described disc 271 of the scroll compressor 210 are cut by a plane spreading in the axial direction of a crankshaft 250 (the vertical direction).

The scroll compressor 210 pertaining to the third embodiment differs from the scroll compressor 10 pertaining to the first embodiment in that it is equipped with the cylinder member 280, in which an upper counterweight 260 is integrally formed with a side surface portion 281 and an upper surface portion 282 that enclose the lateral side and upper side of the counterweight passing space Sbw. It should be noted that the counterweight passing space Sbw is, like in the first embodiment, a space through which at least part of the upper counterweight 260 passes when the crankshaft 250 rotates 360°.

Furthermore, the scroll compressor 210 differs from the scroll compressor 10 pertaining to the first embodiment in that the disc 271 that encloses the lower side of the counterweight passing space Sbw is not formed integrally with either the crankshaft 250 or the upper counterweight 260. The disc 271 is secured, by a bolt 272 serving as an example of a fastening member, to the upper counterweight 260 that the cylinder member 280 has.

Furthermore, the scroll compressor 210 differs from the scroll compressor 10 pertaining to the first embodiment in that the crankshaft 250 and the upper counterweight 260 are not formed integrally with each other. The cylinder member 280 having the upper counterweight 260, the side surface portion 281, and the upper surface portion 282 is secured to the crankshaft 250 by shrink fitting.

The crankshaft 250, the cylinder member 280, and the disc 271 will be described below, and description regarding other parts will be omitted.

(1) Detailed Configuration (1-1) Crankshaft

The crankshaft 250 differs from the crankshaft 50 of the first embodiment in that it is not formed integrally with the upper counterweight 260 (the cylinder member 280 having the upper counterweight 260). Furthermore, the crankshaft 250 differs from the crankshaft 50 of the first embodiment in that it is not formed integrally with the disc 271 of the later-described oil outflow reduction member 270.

The crankshaft 250 is the same as the crankshaft 50 of the first embodiment except for these points, so other description will be omitted.

(1-2) Cylinder Member

The cylinder member 280 is a member in which the upper counterweight 260, the side surface portion 281 that encloses the lateral side of the counterweight passing space Sbw, and the upper surface portion 282 that encloses the upper side of the counterweight passing space Sbw are formed integrally with each other.

Specifically, the cylinder member 280 is formed in the shape of a thick-walled open cylinder that is hollowed out in the axial direction of the crankshaft 250, leaving, in a segment spanning roughly 180° in the circumferential direction, the side surface portion 281 that encloses the lateral side of the counterweight passing space Sbw, the upper surface portion 282 that encloses the upper side of the counterweight passing space Sbw, and an inner surface portion 283 on the central side of the thick-walled open cylinder (see FIG. 8 and FIG. 9). In other words, the cylinder member 280 is the thick-walled open cylinder in which is formed, in the segment spanning roughly 180° in the circumferential direction, a recess portion enclosed by the side surface portion 281, the upper surface portion 282, and the inner surface portion 283 (see FIG. 8 and FIG. 9). In the cylinder member 280, the side of the thick-walled open cylinder that is not hollowed out (the side in which the recess portion is not formed (the left side in FIG. 8)) functions as the upper counterweight 260. It should be noted that the outer edge side of the upper counterweight 260 functions as the side surface portion 281 and that the upper edge side of the upper counterweight 260 functions as the upper surface portion 282. It should be noted that although here the cylinder member 280 is described as having the shape of the thick-walled open cylinder that is hollowed out, the cylinder member 280 does not need to be formed by following out the thick-walled open cylinder by machining and may be formed in the above shape by casting or the like.

A hole 280*a* (see FIG. 8) is formed in the center of the cylinder member 280. The crankshaft 250 is inserted into the hole 280*a* in the cylinder member 280 and is secured thereto by shrink fitting. As a result, the upper counterweight 260 which the cylinder member 280 secured to the crankshaft 250 has is integrated with the crankshaft 250. It should be noted that the method of securing the cylinder member 280 and the crankshaft 250 to each other is an exemplification and the securing method is not limited to shrink fitting.

The upper counterweight 260 that the cylinder member 280 has is, like the upper counterweight 60 of the first embodiment, disposed adjacent to the rotor 42. (see FIG. 7). The upper counterweight 260 is disposed above the rotor 42 of the electric motor 40 (see FIG. 7). Furthermore, the upper counterweight 260 is, like the upper counterweight 60 of the first embodiment, disposed on the lower side of the housing 33 and adjacent to the housing 33 (see FIG. 7). The upper counterweight 260 is, like the upper counterweight 60 of the first embodiment, used together with the lower counterweight 80 to eliminate imbalances in the mass distribution of rotating bodies including the rotor 42 of the electric motor 40 and the crankshaft 250 and reduce vibration of the rotating bodies.

The side surface portion 281 and the upper surface portion 282 of the cylinder member 280 will be described later.

(1-3) Oil Outflow Reduction Member

The oil outflow reduction member 270 is, like the oil outflow reduction member 70 pertaining to the first embodiment, a member for reducing oil outflow. The oil outflow reduction member 270 may be a magnetic body or a non-magnetic body.

The oil outflow reduction member 270 mainly includes the side surface portion 281 and the upper surface portion 282, which the cylinder member 280 has, and the disc 271, which is secured to the lower surface of the upper counterweight 260 that the cylinder member 280 has.

The side surface portion 281 is formed in the shape of a cylinder and encloses the lateral side of the counterweight passing space Sbw. The upper surface portion 282 is formed in an annular shape and encloses the upper side of the counterweight passing space Sbw. In other words, the upper surface portion 282 encloses the side (the housing 33 side) of the counterweight passing space Sbw distal from the rotor 42 in the axial direction of the crankshaft 250. The disc 271 is an annular member that encloses the lower side of the counterweight passing space Sbw. The overall outer shape of the oil outflow reduction member 270 is formed in the shape of a cylinder in a state in which it is attached to the crankshaft 250 (in a state in which the cylinder member 280 is attached to the crankshaft 250 and the disc 271 is attached to the upper counterweight 260). The oil outflow reduction member 270 rotates integrally with the crankshaft 250 because the cylinder member 280 having the side surface portion 281 and the upper surface portion 282 is secured to the crankshaft 250 by shrink fitting and the disc 271 is secured to the upper counterweight 260 which the cylinder member 280 has.

The disc 271 is an annular flat plate in the central portion of which is formed a hole 271*a* (see FIG. 9) for inserting the main shaft 52 of the crankshaft 250. The disc 271 is secured to the lower surface of the upper counterweight 260 by the bolt 272. The disc 271 encloses the side of the counterweight passing space Sbw on the rotor 42 side of the electric motor 40. In other words, the disc 271 encloses the lower side of the counterweight passing space Sbw.

It should be noted that a radius R6 (see FIG. 9) of the outer periphery of the disc 271 is identical to a radius R5 (see FIG. 8) of the outer periphery of the cylinder member 280. Furthermore, the diameter of the disc 271—that is, an outer diameter D5 (see FIG. 9) of the disc 271—is identical to the diameter of the rotor 42 formed in the shape of a cylinder—that is, the outer diameter D2 (see FIG. 7) of the rotor 42.

In contrast to the first embodiment, a gap is not formed between the side surface portion 281 of the cylinder member 280 that encloses the lateral side of the counterweight passing space Sbw and the disc 271 that encloses the lower side of the counterweight passing space Sbw. As in FIG. 9 the lower surface of the side surface portion 281 and the upper surface of the disc 271 are in tight contact with each other.

However, in a case where there is the potential for the refrigerating machine oil L or the like to enter the counterweight passing space Sbw, imbalances in the rotating bodies may become more difficult to be eliminated. Therefore, it is preferred that a gap is formed between the disc 271 and the side surface portion 281 so that the refrigerating machine oil L is expelled therefrom.

(2) Characteristics

The scroll compressor 210 of the third embodiment has the same characteristics as those in (4-1), (4-2), (4-3), and (4-8) given as characteristics of the scroll compressor 10 of the first embodiment. Furthermore, the scroll compressor 210 of the third embodiment has the same characteristics as those in (2-1) and (2-3) given as characteristics of the scroll compressor 110 of the second embodiment.

Fourth Embodiment

A scroll compressor 310 pertaining to a fourth embodiment of the present invention will be described.

Figure 10:
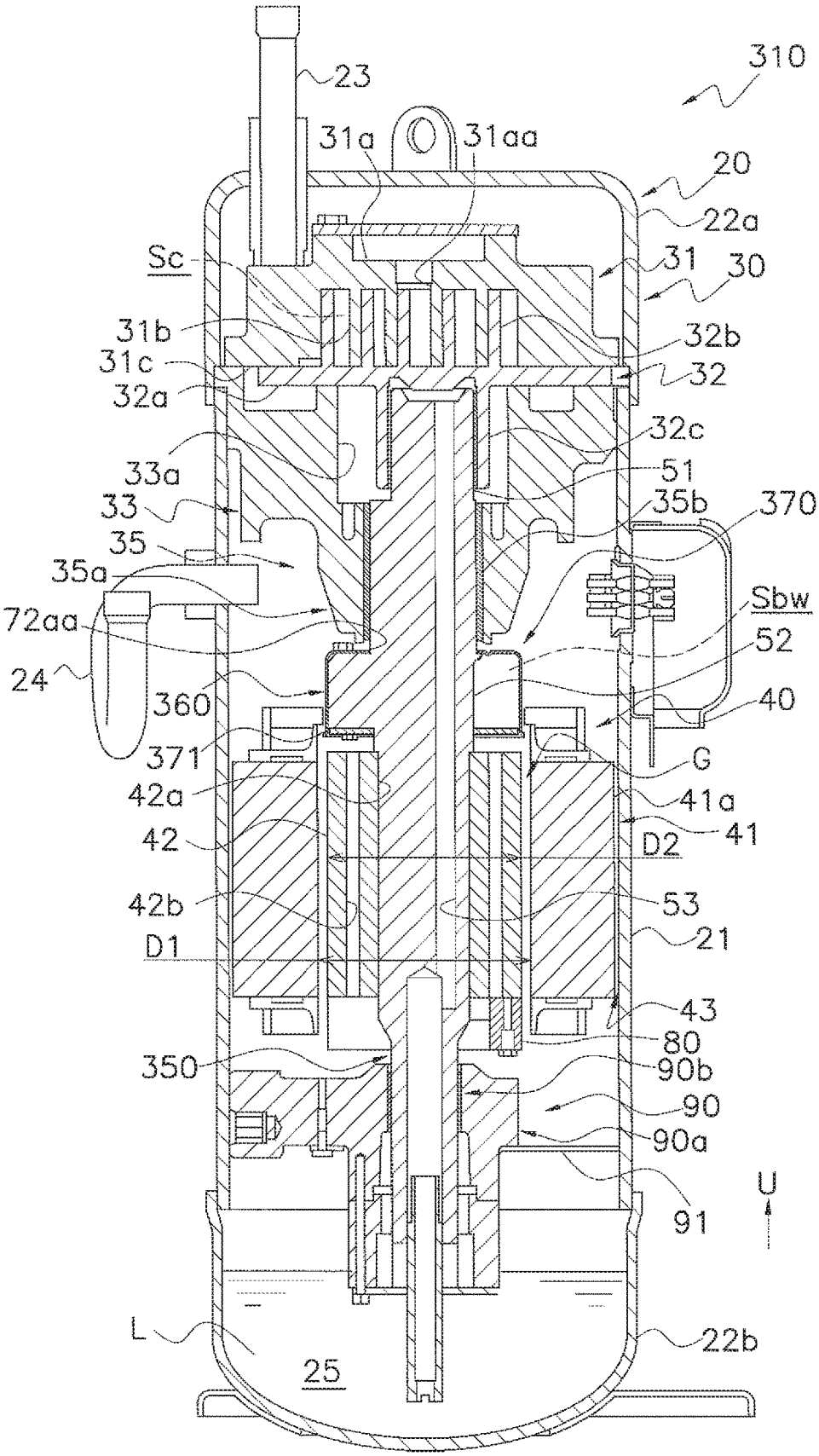
FIG. 10 is a general longitudinal sectional view of a scroll compressor pertaining to a fourth embodiment of the present invention.
Figure 11:
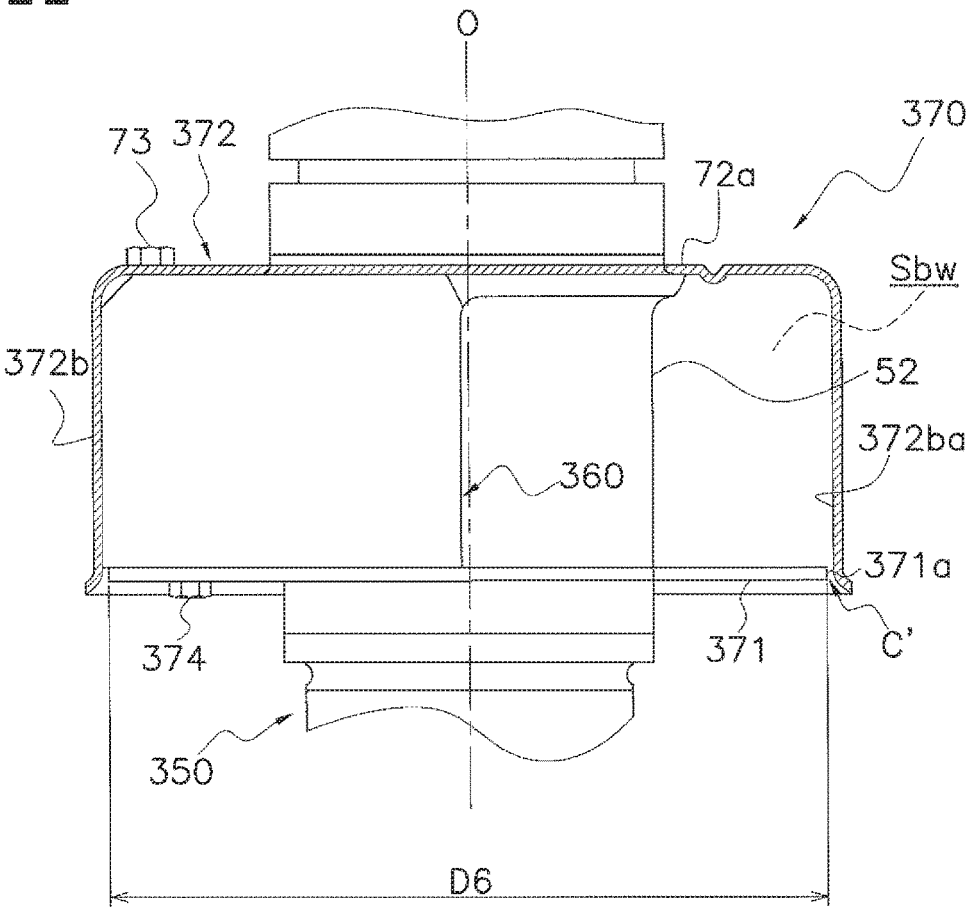
FIG. 11 is an enlarged view of the area around an upper counterweight of the scroll compressor of FIG. 10.
Figure 12:
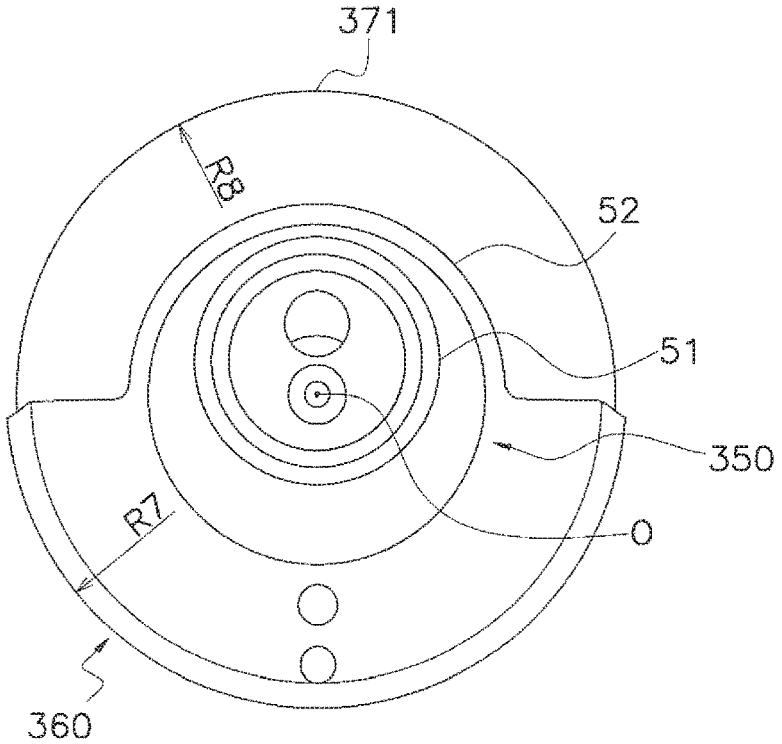
FIG. 12 is a plan view in which the crankshaft and the upper counterweight of the scroll compressor of FIG. 10 are viewed from above in a state in which the cover of the oil outflow reduction member is detached.

FIG. 10 is a general longitudinal sectional view of the scroll compressor 310 pertaining to the fourth embodiment. FIG. 11 is an enlarged view of the area around a later-described upper counterweight 360 of the scroll compressor 310. FIG. 11 depicts a state in which a cover 372 of a later-described oil outflow reduction member 370 is cut by a plane extending in the axial direction of a crankshaft 350. FIG. 12 is a plan view in which the crankshaft 350 and the upper counterweight 360 of the scroll compressor 310 are viewed from above in a state in which the cover 372 of the oil outflow reduction member 370 is detached.

The scroll compressor 310 pertaining to the fourth embodiment is the same as the scroll compressor 10 pertaining to the first embodiment except for the crankshaft 350, the upper counterweight 360, and the oil outflow reduction member 370 (see FIG. 4). Here, the crankshaft 350, the upper counterweight 360, and the oil outflow reduction member 370, which differ from the scroll compressor 10, will be described, and description regarding other parts will be omitted.

(1) Detailed Configuration

Details regarding the crankshaft 350, the upper counterweight 360, and the oil outflow reduction member 370 will be described below. It should be noted that the crankshaft 350, the upper counterweight 360, and the oil outflow reduction member 370 have many of the same points as the crankshaft 50, the upper counterweight 60, and the oil outflow reduction member 70 of the scroll compressor 10 of the first embodiment, so mainly their points of difference will be described.

(1-1) Crankshaft

The crankshaft 350 is, like the crankshaft 50 of the first embodiment, formed integrally with the upper counterweight 360. However, in contrast to the crankshaft 50 of the first embodiment, the crankshaft 350 is not formed integrally with a disc 371 of the later-described oil outflow reduction member 370.

Except for this point the crankshaft 350 is the same as the crankshaft 50 of the first embodiment, so other description will be omitted.

(1-2) Upper Counterweight

The upper counterweight 360 is, like the upper counterweight 60 of the first embodiment, used together with the lower counterweight 80 to eliminate imbalances in the mass distribution of rotating bodies including the rotor 42 of the electric motor 40 and the crankshaft 350 and reduce vibration of the rotating bodies.

The upper counterweight 360 is, like the upper counterweight 60 of the first embodiment, disposed above the rotor 42 of the electric motor 40 and adjacent to the rotor 42 (see FIG. 10). Furthermore, the upper counterweight 360 is, like the upper counterweight 60 of the first embodiment, disposed below the housing 33 and adjacent to the housing 33 (see FIG. 10).

The upper counterweight 360 differs from the upper counterweight 60 of the first embodiment in that it is not formed integrally with the disc 371 of the oil outflow reduction member 370. A screw hole (not shown in the drawings) for screwing in a bolt 374 (see FIG. 11) is formed in the lower portion of the upper counterweight 360. The upper counterweight 360 and the disc 371 are integrated with each other by inserting the bolt 374 through a hole (not shown in the drawings) formed in the disc 371 and screwing it into the screw hole in the lower portion of the upper counterweight 360 in a state in which the lower surface of the upper counterweight 360 and the upper surface of the disc 371 of the oil outflow reduction member 370 are in tight contact with each other. It should be noted that the securement by means of the bolt 374 is an example of a method of securing the upper counterweight 360 and the disc 371 to each other. The upper counterweight 360 and the disc 371 may be secured to each other using another fastening member such as a rivet, for example.

The upper counterweight 360 is, like the upper counterweight 60 of the first embodiment, formed in the shape of a hollow half cylinder extending in the axial direction of the crankshaft 350 (see FIG. 11 and FIG. 12). That is to say, the upper counterweight 360 is formed in a semi-annular shape centered on the center O of the main shaft 52 of the crankshaft 350 when viewed from above (see FIG. 11) like the upper counterweight 60 of the first embodiment. The main shaft 52 of the crankshaft 350 is disposed in the hollow portion of the upper counterweight 360 shaped like a hollow half cylinder (see FIG. 12). It should be noted that a radius R7 of the outer periphery of the upper counterweight 360 whose outer shape is formed in a semi-circular shape is larger than a radius R8 of the outer periphery of the later-described disc 371 (see FIG. 12).

The cover 372 of the oil outflow reduction member 370 is attached by the bolt 73 to the upper portion of the upper counterweight 360 like the upper counterweight 60 of the first embodiment (see FIG. 11).

The disc 371 is provided below the upper counterweight 360, and the cover 372 is attached to the upper portion of the upper counterweight 360; thus, the counterweight passing space Sbw is enclosed on its lower side by the disc 371 and on its lateral and upper sides by the cover 372 (see FIG. 11). It should be noted that the counterweight passing space Sbw is, like in the first embodiment, a space through which at least part of the upper counterweight 360 passes when the crankshaft 350 rotates 360°.

(1-3) Oil Outflow Reduction Member

The oil outflow reduction member 370, like the oil outflow reduction member 70 pertaining to the first embodiment, encloses the upper side, lower side, and lateral side of the counterweight passing space Sbw through which at least part of the upper counterweight 360 passes when the crankshaft 350 rotates 360°. The oil outflow reduction member 370 may be a magnetic body or a nonmagnetic body.

The oil outflow reduction member 370, like the oil outflow reduction member 70 of the first embodiment, mainly has the disc 371 and the cover 372 (see FIG. 11).

The disc 371 is not formed integrally with the crankshaft 350 and the upper counterweight 360 and is a member separate from the crankshaft 350 and the upper counterweight 360. The disc 371 is an annular flat plate in the central portion of which is formed a hole (not shown in the drawings) for inserting the main shaft 52 of the crankshaft 350. A hole (not shown in the drawings) for passing the bolt 374 through is also formed in the disc 371. As described above, the disc 371 is secured by the bolt 374 to the lower surface of the upper counterweight 360. The disc 371 encloses the counterweight passing space Sbw at the rotor 42 side of the electric motor 40. In other words, the disc 371 encloses the lower side of the counterweight passing space Sbw.

The radius R8 of the outer periphery of the disc 371 is smaller than the radius R7 of the outer periphery of the upper counterweight 360 (see FIG. 12). Furthermore, the diameter of the disc 371—that is, an outer diameter D6 (see FIG. 11) of the disc 371—is smaller than the diameter of the rotor 42 formed in the shape of a cylinder—that is, the outer diameter D2 (see FIG. 10) of the rotor 42.

The oil outflow reduction member 370 differs from the oil outflow reduction member 70 of the first embodiment in that a gap C' is formed between an outer peripheral surface 371*a* of the disc 371 and an inner peripheral surface 372*ba* of a lateral portion 372*b* of the cover 372 opposing the outer peripheral surface 371*a* as the radius R8 of the outer periphery of the disc 371 is smaller than the radius R7 of the outer periphery of the upper counterweight 360 housed inside the cover 372. That is to say, in the first embodiment the gap C is formed between the disc 71 and the cover 72 by changing the shape of the lower portion of the lateral portion 72*b* of the cover 72 partly, but in the present embodiment the gap C' is formed without changing the shape of the lower portion of the lateral portion 372*b* of the cover 372 (the shape of the lower portion is the same all the way around) but rather by making the outer diameter of the disc 371 smaller than the inner diameter of the cover 372. The role of the gap C' is the same as that of the gap C of the first embodiment.

Except for these points the cover 372 is the same as the cover 72 of the first embodiment, so other description will be omitted.

The overall outer shape of the oil outflow reduction member 370 is formed in the shape of a cylinder extending in the axial direction of the crankshaft 350 by the disc 371 that is disposed on the lower side (the rotor 42 side) of the counterweight passing space Sbw, the upper disc portion 72*a* of the cover 372 that is shaped like a disc and is disposed on the upper side (the housing 33 side) of the counterweight passing space Sbw, and the lateral portion 372*b* of the cover 372 that is shaped like a hollow cylinder.

The oil outflow reduction member 370 rotates integrally with the crankshaft 350 because the disc 371 and the cover 372 are secured to the upper counterweight 360 formed integrally with the crankshaft 350.

(2) Characteristics

The scroll compressor 310 of the fourth embodiment has the same characteristics as those of (4-1), (4-2), (4-3), (4-5), and (4-6) given as characteristics of the scroll compressor 10 in the first embodiment. Furthermore, the scroll compressor 310 of the fourth embodiment has the same characteristics as those in (2-1) and (2-3) given as characteristics of the scroll compressor 110 of the second embodiment.

In addition, the scroll compressor 310 of the fourth embodiment has the following characteristic.

(2-1)

In the scroll compressor 310 of the present embodiment, the radius R8 of the disc 371 is smaller than the radius R7 of the upper counterweight 360 formed in a semicircular shape.

Here, when attaching the cover 372 to the upper counterweight 360, it is easy to prevent the occurrence of a situation where the cover 372 cannot be attached because of the presence of the disc 371.

<Example Modifications>

Some of the characteristics of the configurations of the scroll compressors 10, 110, 210, and 310 pertaining to the first, second, third, and fourth embodiments may be combined to the configurations of the scroll compressors 10, 110, 210, and 310 pertaining to other embodiments.

Example modifications of the first, second, third, and fourth embodiments will be described below. It should be noted that several of the example modifications described below may be combined to the extent that they do not contradict each other.

(1) Example Modification A

In the above embodiments, the oil outflow reduction members 70, 170, 270, and 370 are formed in the shape of a cylinder, but they are not limited to this. For example, the oil outflow reduction members 70, 170, 270, and 370 may be formed in the shape of a prism or the shape of an elliptical cylinder. However, it is preferred that the oil outflow reduction members 70, 170, 270, and 370 are formed in the shape of a cylinder in order to reduce oil outflow, because it is preferred that a pressure difference does not occur around the oil outflow reduction members 70, 170, 270, and 370 when the oil outflow reduction members 70, 170, 270, and 370 rotates integrally with the crankshafts 50, 150, 250, and 350.

(2) Example Modification B

In the second embodiment, the second counterweight 162 is formed integrally with the crankshaft 150, and the first counterweight 161 is not formed integrally with the crankshaft 150, but the second embodiment is not limited to this. For example, the first counterweight 161 may be formed integrally with the crankshaft 150, and the second counterweight 162 may not be formed integrally with the crankshaft 150. However, from the standpoint of the ease of manufacture of the crankshaft 150, it is preferred that the first counterweight 161 formed integrally with the disc 171 is separate from the crankshaft 150 and that the second counterweight 162 is formed integrally with the crankshaft 150.

(3) Example Modification C

The compressors pertaining to the above embodiments are scroll compressors, but they are not limited to this. For example, the oil outflow reduction member, which is adjacent to the rotor of the electric motor and encloses the counterweight integrated with the crankshaft and the upper side, lower side, and lateral side of the counterweight passing space, may also be may be provided in a rotary compressor.

(4) Example Modification D

The compressors pertaining to the above embodiments are the vertical scroll compressors 10, 110, 210, and 310 in which the crankshafts 50, 150, 250, and 350 extend in the vertical direction, but they are not limited to this. For example, the same configurations may also be applied to horizontal scroll compressors in which the crankshaft extends in the horizontal direction.

(5) Example Modification E

Figure 13:
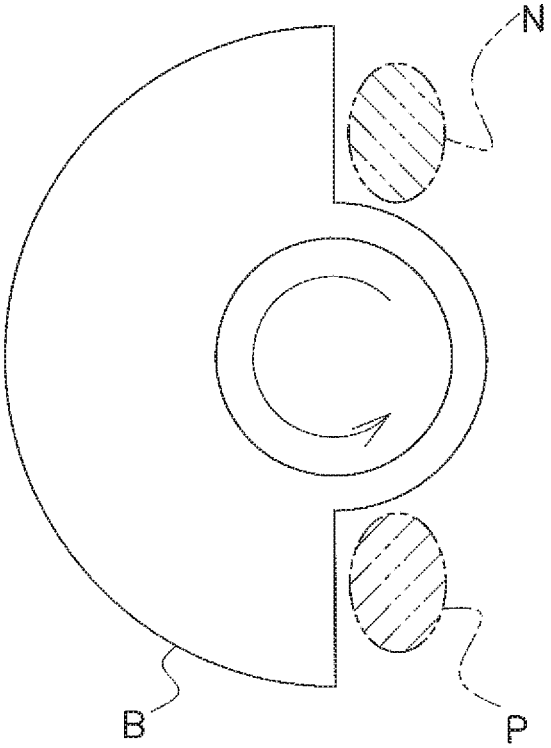
(Prior Art) FIG. 13
FIG. 13 is a drawing describing a pressure difference that occurs around a counterweight in a conventional compressor where just the lateral side of a counterweight passing space is enclosed by a hollow cylinder.

In the above embodiments, the oil outflow reduction members 70, 170, 270, and 370 are provided to the upper counterweights 60, 160, 260, and 360 that are disposed above the rotor 42 and are integrated with the crankshafts 50, 150, 250, and 350, but they are not limited to this. For example, in a case where a counterweight that is the same as the upper counterweight 60, 160, 260, or 360 is provided below the rotor 42, there is the potential for a pressure difference as shown in FIG. 13 to occur around the counterweight and producing a flow of gas refrigerant that brings the mist of the refrigerating machine oil L from the space below the rotor 42 to the space above the rotor 42. Therefore, in a case where a counterweight that is the same as the upper counterweight 60, 160, 260, or 360 is disposed below the rotor 42, it is preferred that an oil outflow reduction member with the same configuration as that of the oil outflow reduction member 70, 170, 270, or 370 be provided.

(6) Example Modification F

In the second embodiment, the bolts 163 were given as an example of a fastening member for coupling the first counterweight 161 and the second counterweight 162 to each other, but the method of coupling the first counterweight 161 and the second counterweight 162 to each other is not limited to this. For example, the first counterweight 161 and the second counterweight 162 may be secured to each other by pins or the like.

INDUSTRIAL APPLICABILITY

The present invention is useful as a compressor capable of reducing oil outflow caused by a counterweight.

What is claimed is:

1. A compressor comprising:

a crankshaft;

a hearing pivotally supporting the crankshaft;

an electric motor having a rotor coupled to the crankshaft and a stator in which the rotor is housed with an air gap formed therebetween;

a counterweight being disposed adjacent to the rotor and being integrated with the crankshaft; and an oil outflow reduction member enclosing an upper side, a lower side, and a lateral side of a counterweight passing space through which at least part of the counterweight passes when the crankshaft rotates 360°, the oil outflow reduction member reducing inflow of oil into the counterweight passing space, the oil outflow reduction member being formed in a cylinder shape extending in an axial direction of the crankshaft, the oil outflow reduction member including an upper surface portion enclosing the counterweight passing space from above, a side surface portion enclosing the counterweight passing space from the lateral side, and a disc enclosing the counterweight passing space from below, with the disc being spaced above the rotor, the oil outflow reduction member rotating together with the counterweight, the counterweight and the oil outflow reduction member being disposed between the bearing and the rotor of the electric motor, the upper surface portion of the oil outflow reduction member having a hole that receives the crankshaft therethrough, and the side surface portion of the oil outflow reduction member extending downward along the axial direction of the crankshaft from an outer rim of the upper surface portion, the side surface portion being free of a hole through which oil is transmitted.

2. The compressor according to claim 1, wherein the oil outflow reduction member rotates integrally with the crankshaft.

3. The compressor according to claim 2, wherein the counterweight and the disc are formed integrally with the crankshaft.

4. The compressor according to claim 3, wherein the oil outflow reduction member includes a cover, which encloses the lateral side of the counterweight passing space and a distal side of the counterweight passing space distal from the rotor in the axial direction of the crankshaft.

5. The compressor according to claim 4, wherein the counterweight is disposed above the rotor, and a gap is formed between the disc and the cover in at least part of an area between the disc and the cover.

6. The compressor according to claim 5, wherein an outer diameter of the disc is larger than an outer diameter of the rotor, the rotor being formed in a cylinder shape, and is smaller than an inner diameter of the stator in which the rotor is housed.

7. The compressor according to claim 2, wherein the disc is formed in an annular shape and is formed as a member separate from the crankshaft.

8. The compressor according to claim 7, wherein the counterweight includes a first counterweight formed integrally with the disc and being disposed adjacent the rotor; and a second counterweight formed integrally with the crankshaft and being coupled to the first counterweight by a fastening member, and the fastening member is disposed so the fastening member does not project below the disc.

9. The compressor according to claim 1, wherein the counterweight and the disc are formed integrally with the crankshaft.

10. The compressor according to claim 9, wherein the oil outflow reduction member includes a cover, which encloses the lateral side of the counterweight passing space and a distal side of the counterweight passing space distal from the rotor in the axial direction of the crankshaft.

11. The compressor according to claim 10, wherein the counterweight is disposed above the rotor, and a gap is formed between the disc and the cover in at least part of an area between the disc and the cover.

12. The compressor according to claim 11, wherein an outer diameter of the disc is larger than an outer diameter of the rotor, the rotor being formed in a cylinder shape, and is smaller than an inner diameter of the stator in which the rotor is housed.

13. The compressor according to claim 9, wherein a radius of the disc is identical to a radius of the counterweight, the counterweight being formed in a semicircular shape.

14. The compressor according to claim 9, wherein an outer diameter of the disc is equal to or smaller than an outer diameter of the rotor, the rotor being formed in a cylinder shape.

15. The compressor according to claim 1, wherein the disc is formed in an annular shape and is formed as a member separate from the crankshaft.

16. The compressor according to claim 15, wherein the counterweight includes a first counterweight formed integrally with the disc and being disposed adjacent the rotor; and a second counterweight formed integrally with the crankshaft and being coupled to the first counterweight by a fastening member, and the fastening member is disposed so the fastening member does not project below the disc.

17. The compressor according to claim 6, wherein the oil outflow reduction member includes a cover, which encloses the lateral side of the counterweight passing space and a distal side of the counterweight passing space distal from the rotor in the axial direction of the crankshaft.

18. The compressor according to claim 15, wherein the oil outflow reduction member includes a cover, which encloses the lateral side of the counterweight passing space and a distal side of the counterweight passing space distal from the rotor in the axial direction of the crankshaft.

19. The compressor according to claim 18, wherein the counterweight is disposed above the rotor, and a gap is formed between the disc and the cover in at least part of an area between the disc and the cover.

20. The compressor according to claim 1, wherein an outer diameter of the disc is equal to or smaller than an outer diameter of the rotor, the rotor being formed in a cylinder shape.

21. A compressor comprising:

a crankshaft;

a bearing pivotally supporting the crankshaft;

an electric motor having a rotor coupled to the crankshaft and a stator in which the rotor is housed with an air gap formed therebetween;

a counterweight being disposed adjacent to the rotor and being integrated with the crankshaft; and an oil outflow reduction member enclosing an upper side, a lower side, and a lateral side of a counterweight passing space through which at least part of the counterweight passes when the crankshaft rotates 360°, the oil outflow reduction member reducing inflow of oil into the counterweight passing space, the oil outflow reduction member being formed in a cylinder shape extending in an axial direction of the crankshaft, the oil outflow reduction member including an upper surface portion enclosing the counterweight passing space from above, a side surface portion enclosing the counterweight passing space from the lateral side, and a disc enclosing the counterweight passing space from below, with the disc being spaced above the rotor, the oil outflow reduction member rotating together with the counterweight, the counterweight and the oil outflow reduction member being disposed between the bearing and the rotor of the electric motor, the upper surface portion of the oil outflow reduction member having a hole that receives the crankshaft therethrough, and the side surface portion of the oil outflow reduction member extending downward along the axial direction of the crankshaft from an outer rim of the upper surface portion, the upper surface portion being free of another hole through which oil is transmitted.

* * * * *